US006439690B2

(12) United States Patent
Ishinaga et al.

(10) Patent No.: US 6,439,690 B2
(45) Date of Patent: Aug. 27, 2002

(54) ELEMENT SUBSTRATE HAVING CONNECTING WIRING BETWEEN HEAT GENERATING RESISTOR ELEMENTS AND INK JET RECORDING APPARATUS

(75) Inventors: Hiroyuki Ishinaga, Tokyo; Kazuaki Masuda, Kawasaki; Junji Shimoda, Chigasaki; Masami Kasamoto, Ayase; Fumio Murooka, Atsugi; Tatsuo Furukawa, Isehara; Jun Kawai, Tokyo; Hiroyuki Maru, Atsugi; Teruo Arashima, Kawasaki; Masaaki Izumida, Kawasaki; Yoshinori Misumi, Tokyo; Yuji Kamiyama, Fujisawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/885,479

(22) Filed: Jun. 20, 2001

Related U.S. Application Data

(60) Continuation of application No. 09/215,745, filed on Dec. 17, 1998, now abandoned, which is a division of application No. 08/951,099, filed on Oct. 15, 1997, now Pat. No. 5,880,762, which is a division of application No. 08/546,084, filed on Oct. 20, 1995, now Pat. No. 5,731,828.

(30) Foreign Application Priority Data

Oct. 20, 1994 (JP) ..... 6-255631

(51) Int. Cl.[7] ..... B41J 2/14; B41J 2/16; B41J 2/05

(52) U.S. Cl. ..... 347/48; 347/58

(58) Field of Search ..... 347/48, 56, 62, 347/65, 15, 67, 57, 58, 19, 59

(56) References Cited

U.S. PATENT DOCUMENTS

| | | | | |
|---|---|---|---|---|
| 4,251,824 A | * | 2/1981 | Hara et al. | 347/48 |
| 4,317,124 A | | 2/1982 | Shirato et al. | 347/67 |
| 4,353,079 A | | 10/1982 | Kawanabe | 347/12 |
| 4,419,677 A | | 12/1983 | Kasugayama et al. | 347/87 |
| 4,458,256 A | | 7/1984 | Shirato et al. | 347/574 |
| 4,646,110 A | | 2/1987 | Ikeda et al. | 347/15 |
| 4,723,129 A | | 2/1988 | Endo et al. | 347/574 |
| 4,860,033 A | | 8/1989 | Shiozaki et al. | 347/64 |
| 4,875,059 A | | 10/1989 | Masuda | 347/93 |
| 4,965,594 A | * | 10/1990 | Komuro | 347/62 |
| 4,980,702 A | | 12/1990 | Kneezel et al. | 347/17 |
| 4,994,825 A | | 2/1991 | Saito et al. | 347/63 |
| 5,081,474 A | | 1/1992 | Shibata et al. | 347/59 |
| 5,095,321 A | | 3/1992 | Saito et al. | 347/63 |
| 5,148,192 A | | 9/1992 | Izumida et al. | 347/44 |
| 5,172,139 A | | 12/1992 | Kneezel et al. | 347/48 |
| 5,182,577 A | | 1/1993 | Ishinaga | 347/58 |
| 5,189,443 A | | 2/1993 | Arashima | 347/63 |
| 5,208,604 A | | 5/1993 | Watanabe et al. | 347/47 |
| 5,214,450 A | | 5/1993 | Shimoda | 347/12 |

(List continued on next page.)

FOREIGN PATENT DOCUMENTS

| | | |
|---|---|---|
| EP | 0 124 312 | 11/1984 |
| EP | 5 505 154 | 9/1992 |
| EP | 0 613 781 | 9/1994 |
| JP | 55 132359 | 10/1980 |
| JP | 58-042466 | 3/1983 |
| JP | 62-35852 | 2/1987 |
| JP | 62-261452 | 11/1987 |
| JP | 1 235 652 | 9/1989 |
| JP | 1-237152 | 9/1989 |
| JP | 2-239940 | 9/1990 |

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet head includes a plurality of liquid flow paths for ejecting the ink; and a plurality of heat generating resistors for the respective liquid flow paths, the heat generating resistor being independently drivable; wherein adjacent ones of the heat generating resistors are spaced by not more than 8 microns.

24 Claims, 19 Drawing Sheets

U.S. PATENT DOCUMENTS

| | | | | |
|---|---|---|---|---|
| 5,300,969 | A | 4/1994 | Miura et al. | 347/12 |
| 5,322,811 | A | 6/1994 | Komuro et al. | 347/594 |
| 5,359,352 | A | 10/1994 | Saite et al. | 347/62 |
| 5,361,087 | A | 11/1994 | Tajima et al. | 347/44 |
| 5,481,287 | A | 1/1996 | Tachihara | 347/62 |
| 5,640,183 | A | 6/1997 | Hackleman | 347/40 |
| 5,646,660 | A | 7/1997 | Murray | 347/59 |
| 5,726,697 | A | 3/1998 | Shimoda | 347/62 |
| 5,731,828 | A | 3/1998 | Ishinaga et al. | 347/62 |
| 5,754,201 | A | 5/1998 | Ishinaga | 347/62 |
| 5,880,762 | A | 3/1999 | Ishinaga et al. | 347/62 |
| 5,943,069 | A | 8/1999 | Kamiyama et al. | 347/14 |

* cited by examiner

| S-HTR | L-HTR |
|---|---|
| OFF | OFF |
| EJECTION=0ng | |

| S-HTR | L-HTR |
|---|---|
| ON | OFF |
| EJECTION=30ng | |

| S-HTR | L-HTR |
|---|---|
| OFF | ON |
| EJECTION=60ng | |

| S-HTR | L-HTR |
|---|---|
| ON | ON |
| EJECTION=90ng | |

| | S-HTR 10ng | M-HTR 20ng | L-HTR 40ng | EJECTION [ng] |
|---|---|---|---|---|
| 1 | OFF | OFF | OFF | 0ng |
| 2 | ON | OFF | OFF | 10ng |
| 3 | OFF | ON | OFF | 20ng |
| 4 | ON | ON | OFF | 30ng |
| 5 | OFF | OFF | ON | 40ng |
| 6 | ON | OFF | ON | 50ng |
| 7 | OFF | ON | ON | 60ng |
| 8 | ON | ON | ON | 70ng |

ELEMENT SUBSTRATE HAVING CONNECTING WIRING BETWEEN HEAT GENERATING RESISTOR ELEMENTS AND INK JET RECORDING APPARATUS

CROSS REFERENCE TO RELATED APPLICATIONS

This is a continuation of application Ser. No. 09/215,745, filed Dec. 17, 1998, now abandoned which is a division of application Ser. No. 08/951,099, filed Oct. 15, 1997 (which issued as U.S. Pat. No. 5,880,762), which is a division of application Ser. No. 08/546,084, filed Oct. 20, 1995 (which issued as U.S. Pat. No. 5,731,828).

FIELD OF THE INVENTION AND RELATED ART

The present invention relates to an ink jet head, an ink jet head cartridge and an ink jet device usable as a printer, a video printer or the like as an output terminal for a copying machine, a facsimile machine, a word processor, a host computer, a video printer or the like. In this specification, recording includes application of ink onto any ink supporting material for receiving the ink, such as textile, thread, paper, sheet material (print), and what is recorded includes meaningful image such as letter or the like and meaningless image such as pattern images. The recording device includes various information processing device or a printer as an output device therefor, and the present invention is applicable to all of them.

An ink jet recording device which ejects ink onto a recording material to effect the recording has been put into practice, and may of them are produced, since it is advantageous in the easiness of downsizing, low noise or the like.

Recently, further downsizing or further improvement of the image quality particularly in color image recording, is demanded. In order to meet the demand, Japanese Laid Open Patent Application No. SHO-55-132259 has proposed a construction wherein a plurality of electrical heat exchange elements are provided in one nozzle. These electrothermal transducer elements are independently controlled and driven, so that size of the ink droplet ejected is controlled to accomplish high image quality recording (tone gradient recording method).

The investigations of the inventors in this respect have revealed the following.

An area of electrothermal transducer element is normally one of an important factors of determination of ejection amount of the ink. However, the maximum ejection amount of the ink when the plurality of the electrothermal transducer elements are used, is not determined by the total of the areas of the plurality of electrothermal transducer elements.

Since the heat produced by an electrothermal transducer element is influential to another electrothermal transducer. Therefore, the desired ink ejection amount is not accomplished easily.

The circuit construction on an element substrate (heater board) for driving the electrothermal transducer element in an example, is as shown in FIG. 22 or FIG. 23.

In FIG. 22, the electric signal is directly supplied to the electrothermal transducer element 012 through wiring and outside end portion 015 (direct wiring construction).

With such a circuit construction, the construction in the element substrate is simple, but as to the number of the contacts, when the number of the electrothermal transducer elements is n, at least n+ one contacts are necessary. When a plurality of electrothermal transducer elements are provided in a single nozzle with such a circuit construction used, a very many electrical connections are necessary between the element substrate and the outside devices, with the result of complication of the-manufacturing step and bulkiness of the element substrate.

The element substrate of FIG. 23 has electrothermal transducer element 012, wiring 013, diode 014 and contact for external connection. When electric energy supply is effected by the matrix construction constituted by wiring and diode. By the use of the diode matrix construction, the number of of the contacts 015 for the external connection is reduced to 2n when the number of of the electrothermal transducer elements is n.

Even if, however, such a wiring construction is used, the number of of the connection contacts is quite large in the case of tone gradient recording head.

As described above, the head having a plurality of of heat generating resistors in 1 nozzle, involves the problem of lowering of the ejection efficiency or deviation from a desired ejection amount.

SUMMARY OF THE INVENTION

Accordingly, it is a principal object of the present invention to provide an ink jet head, a head cartridge, and an ink jet recording device capable of effecting high image quality recording with high tone gradient and improved ejection efficiency.

It is another object of the present invention to provide an ink jet head, ink jet head cartridge and ink jet device wherein increase of the number of of electrical contacts on an element substrate resulting from a plurality of electrothermal transducer elements in a single nozzle and the resultant bulkiness of the substrate, can be prevented.

It is a further object of the present invention to provide a container for ink containing ink properly refilled thereinto, usable in an ink jet head or an ink jet head cartridge according to the present invention.

According to the present invention, the position of a plurality of heat generating resistors are optimization in a single nozzle (flow path).

According to the present invention, the function elements for driving the heat generating resistors in such a head are built in the same element substrate, by which the number of of the electrical contacts for the external connections can be decreased, and the downsizing of the element substrate is accomplished. As an ink container for constituting such an ink jet head or ink jet cartridge, an ink container to which the ink is refilled is used, so that the repeated use is permitted, so that the ink jet cartridge can be used for a long term.

According to an aspect of the present invention, there is provided An ink jet head comprising a plurality of liquid flow paths for ejecting the ink; and a plurality of heat generating resistors for said respective liquid flow paths, said heat generating resistor being independently drivable; wherein adjacent ones of said heat generating resistors are spaced by not more than 8 microns.

According to another aspect of the present invention, there is provided an ink jet head cartridge having a maintaining for containing the ink to above-described ink jet head or the ink jet head.

According to a further aspect of the present invention, there is provided an ink jet device having the ink jet head and transporting means for transporting a recording material.

According to a further aspect of the present invention, there is provided an ink jet device having a driving signal supply means for driving such an ink jet head or said ink jet head.

According to a further aspect of the present invention, there is provided a refilled ink container for above-described ink jet head cartridge.

While the invention has been described with reference to the structures disclosed herein, it is not confined to the details set forth and this application is intended to cover such modifications or changes as may come within the purposes of the improvements or the scope of the following claims.

DESCRIPTION OF THE PREFERRED EMBODIMENTS

Referring to the accompanying drawings, the embodiments of the present invention will be described. In this embodiment, ink is used as the liquid to be ejected, but the present invention is not limited to the ink and is usable with the liquid which can be ejected using the device of the present invention.

Before describing the. embodiment, the description will be made as to the finding obtained by the inventors.

Figure 1:
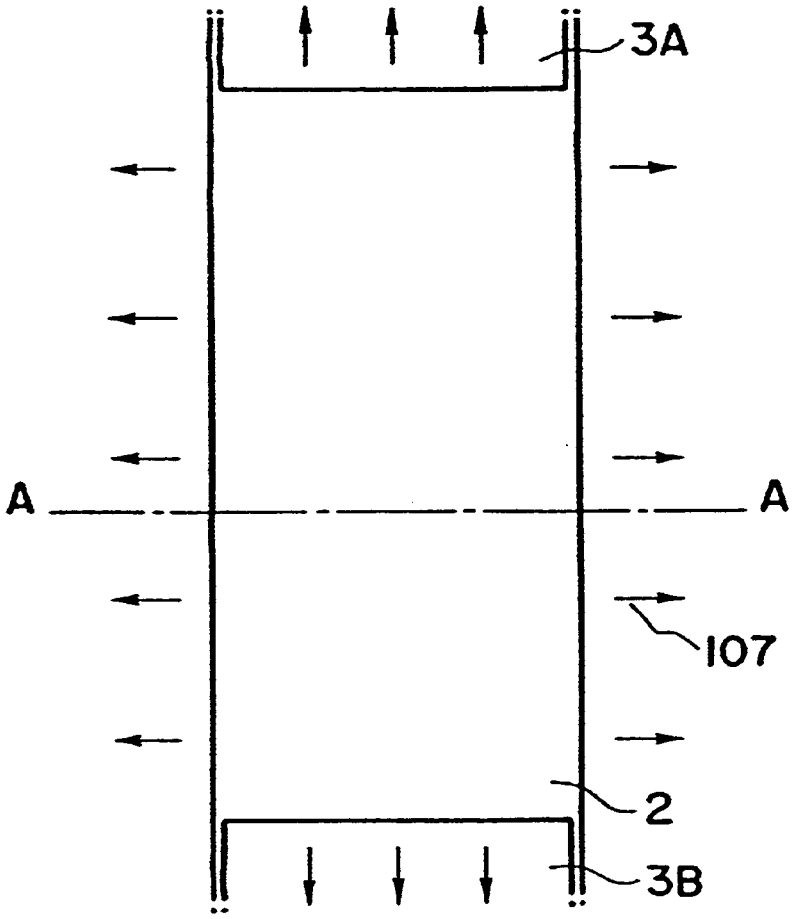
FIGS. 1(*a*) and 1(*b*) illustrate a bubble generation region of an electrothermal transducer element.
Figure 1:
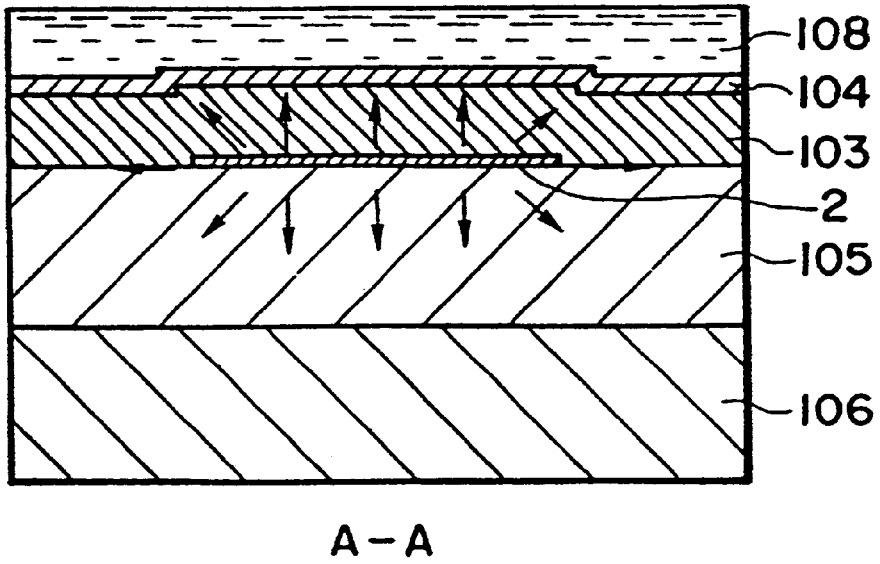

FIG. 1 is a top plan view (a) of an electrothermal transducer element on an element substrate, and a A—A sectional view (b) thereof.

The electrothermal transducer element on the element substrate comprises a heat generating resistor (ejection heater) 2 for producing the heat and electrodes 3A and 3B connected to the ejection heater 2 through a thin film forming process. By application of an electric signal between the two electrodes, current flows through the ejection heater 2 to generate the heat. The heat produced by the ejection heater 2 heat radiates in a direction of arrow 107 in (a) namely along the surface, and in a direction thereacross as shown in same figure (b). The ejection heater 2 has a sandwich structure comprising a heat accumulation layer 105 of low thermal conductivity, a protection layer 103 for protection of the heater and an anti-cavitation layer 104 against shock wave upon collapse of bubble in ink. The base 106 is of silicon crystal or the like. The thickness of the respective layers is determined so as to transfer the heat from the ejection heater 2 to the ink 108. In the case of of the present invention, anti-cavitation layer 104 is 0.1–1.0 micron, protection layer 103 is 0.3–2.0 microns, and heat accumulation layer 105 is 0.5–5.0 microns approx., and the base 106 is 0.5–1.0 mm, in thickness, usually.

When the of the contact surface between the anti-cavitation layer 104 and the ink 108 is approx. 300° C., the bubble generation starts, and is set as a temperature at which the bubble generation occurs stably at the temperature of not less than 300° C. The ejection heater 2 exhibit low durability abruptly when the surface exceeds the temperature of approx. 700–800° C. due to the stress resulting from inserting in thermal-expansion coefficients between the protection layer 103 or between the heat accumulation layer 105 or due to the durable temperature. It is desirable that the surface temperature is controlled so as not to exceed the temperature.

Figure 2:
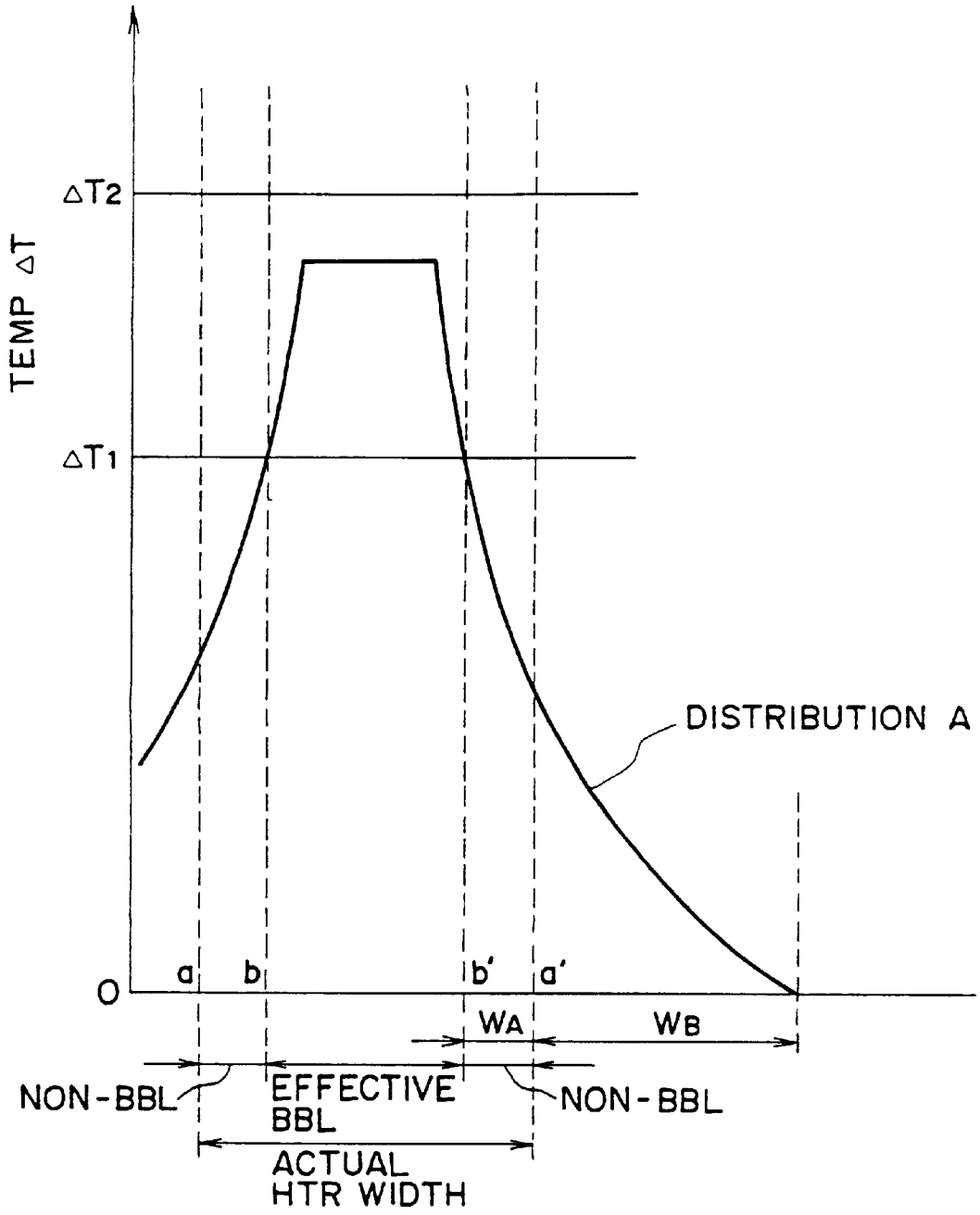
FIG. 2 illustrates a bubble generation region of an electrothermal transducer element.

Referring to FIG. 2, this will be described further using the surface temperature distribution shown therein. The ordinate represents a temperature, and the abscissa represents a distance of the ejection heater in the direction of the flow path cross-section. Here, a–a' corresponds to the width of the heater in FIG. 1, (a), and the temperature distribution at the surface of the anti-cavitation layer 104 is indicated by Temp A. The $\delta T_1$ is a bubble generation start temperature and is approx. 300° C., and $\delta T_2$ is a temperature at which the durability changes abruptly. It is different if the thin film material is different but is usually approx. 700–800° C. With Temp a, the range of $\delta T_1$–$\delta T_2$ temperature region is the region where the bubble generation occurs in the ink, as indicated by b–b' Here, it will be noted that the temperature distribution at the central portion is flat, and the bubble generation/collapse are stably repeated, and therefore, the more stable printing property can be provided if this region is larger. Adjacent the end portion of the heater, the heat radiation occurs in the direction of the surface, as shown in FIG. 1 with the result that the temperature gradually decreases, and $W_A$ is a non-bubble-generation region incapable of bubble generation of the ink although it is on the ejection heater. A further outside portion of the ejection heater exhibit some degree of temperature rise due to the heat radiation in the direction of the surface. Thus, the temperature distribution has an exponentially expanding nature (curve), and therefore, around the ejection heater, a width (approx. 8 microns) of non-bubble-generation exists (non-bubble-generation region). In order to improve the ejection efficiency of the ink by reducing this region, it would be considered to rise the overall temperature. However, if this is done, the temperature of the maximum temperature region at the center portion of the ejection heater would exceed the durability deterioration temperature that is $\delta T_2$ with the result of reduced lifetime of the ejection heater. For this reason, it is difficult to increase the overall temperature.

EMBODIMENT 1

Figure 3:
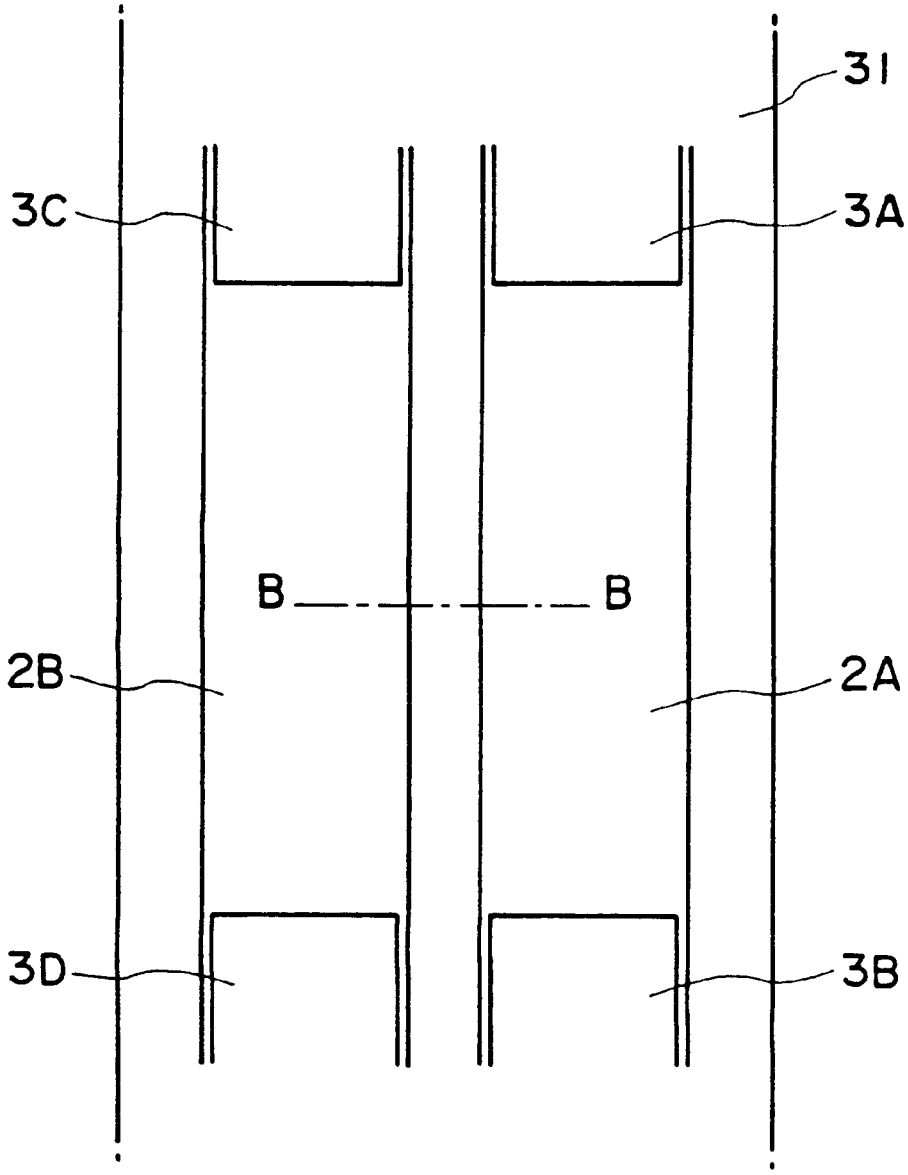
FIG. 3 illustrates a structure wherein a plurality of of electrothermal transducer are provided in 1 flow path.

In the present invent ion, as shown in FIG. 3, one liquid flow path (nozzle) 31 has a plurality of of ejection heaters (heat generating resistors) which are independently drivable. In this embodiment as shown in FIG. 3, there are provided ejection heaters of rectangular forms which are substantially the same having long sides along the liquid flow path. The two ejection heaters are disposed substantially in parallel with each other. They are remote from the ejection outlet substantially at the same distances. By doing so, a temperature distribution as shown in FIG. 4 can be provided by optimizing the positions of the plurality of heat generating resistors, so that the non-bubble-generation region can be reduced while maintaining the temperature of the heater in the stabilization region at $\delta T_1 - \delta T_2$.

Figure 4:
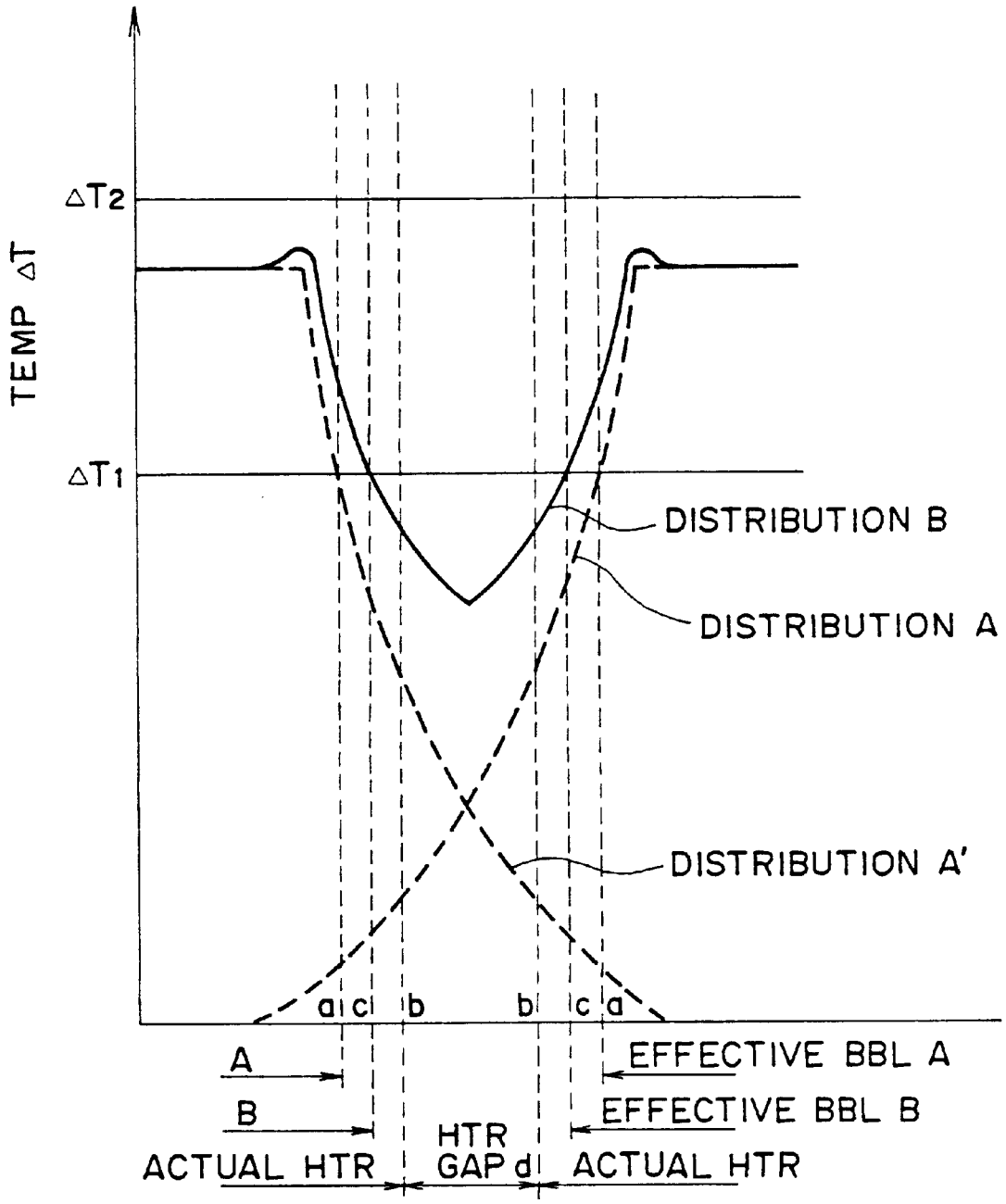
FIG. 4 illustrates a bubble generation region of the electrothermal transducer element in FIG. 3.

FIG. 4 shows a temperature distribution on B—B line between the two heaters in FIG. 3. When the ejection heaters 2A and 2B are independently driven, the temperatures are as indicated by Temp a, Temp a', and therefore, the respective temperatures are the same as conventional ones. When they are simultaneously driven, the portions of the temperature distribution exponentially expanding at the heater edges are overlapped so that the total temperature distribution is as indicated by Temp B, and the effective bubble generation region of the heater is larger as indicated by B than the conventional one as indicated by A. Thus, the non-bubble-generation region is reduced, and the bubble generation efficiency can be enhanced. The non-bubble-generation region is normally a-b which is approx. 8 microns wide, but by using 12 microns as the clearance between 2 heaters (the distance between adjacent edges), it can be reduced to approx. 5 microns. The smaller the distance between heaters, the more effective. If the point at which $\delta T=0$ in the distribution Temp a of one of the heaters is over the other ejection heater, the effect of enlargement of the area of effective bubble generation is provided. Particularly, the effect is high if the distance between the heaters is such that the $\delta T=0$ point of the Temp a reaches the effective bubble generation region of the other heater. The condition satisfying this is $d \leqq 8$ microns. The non-bubble-generation region is decreased by decreasing the clearance between heater s(heat generating resistors) to not more than 8 microns so that effective bubble generation area can be enlargement. If $d \leqq 6$ microns is satisfied, the temperature rise due to the heat radiation from the 8 microns width of the non-bubble-generation regions become not less than twice, and the minimum temperature point in the temperature distribution Temp b exceeds the level $\delta T_1$ with the result that the non-bubble-generation region is reduced. Further preferably, if $d \leqq 4$ microns is satisfied, the bubble generation region can be assured stably with flatter temperature distribution. As will be understood from Temp a of FIG. 2, if the heater width is not more than 16 microns ($2\ W_A$), the bubble generation region does not have a flat surface, and therefore, the effective region hardly exists between the unstable region and the durability deterioration region. However, in the case of the multi-heater as in the present invention, the stabilized effective bubble generation region can be provided even if the heater has a width not more than 16 microns.

The clearance between the heat generating resistors is a clearance between adjacent edges of the heat generating resistors.

By the reduction of the non-bubble-generation region, the following effects are provided.

1. corresponding to the reduction of the heater size required for the predetermined ejection amount, energy saving is accomplished, so that the voltage source cost and the driver cost can be saved.

2. since the heat generation in the non-bubble-generation region results in the wasteful energy and in addition functions to rise the temperature of the head, the viscosity of the ink having the temperature dependence property decreases with the result of variation of the ejection amount and therefore deterioration of the printing quality. However, the above-described reduction of the non-bubble-generation region can suppress the reduction of the viscosity and the deterioration of the printing quality.

These effects are particularly remarkable in a narrow heater having a smaller width.

EMBODIMENT 2

In the foregoing, the non-bubble-generation region of the heat generating resistor is decreased by optimizing the positions of the heat generating resistors (ejection heaters) in one nozzle. In this embodiment, a plurality of heat generating resistor are provided in a single nozzle, similarly, and the circuit of the element substrate is so constructed as to efficiently driving the heat generating resistors and to downsize the element substrate.

In this embodiment, "on the substrate" is not strictly limited to the surface of the substrate but covers the inside portion adjacent the surface.

Figure 5:
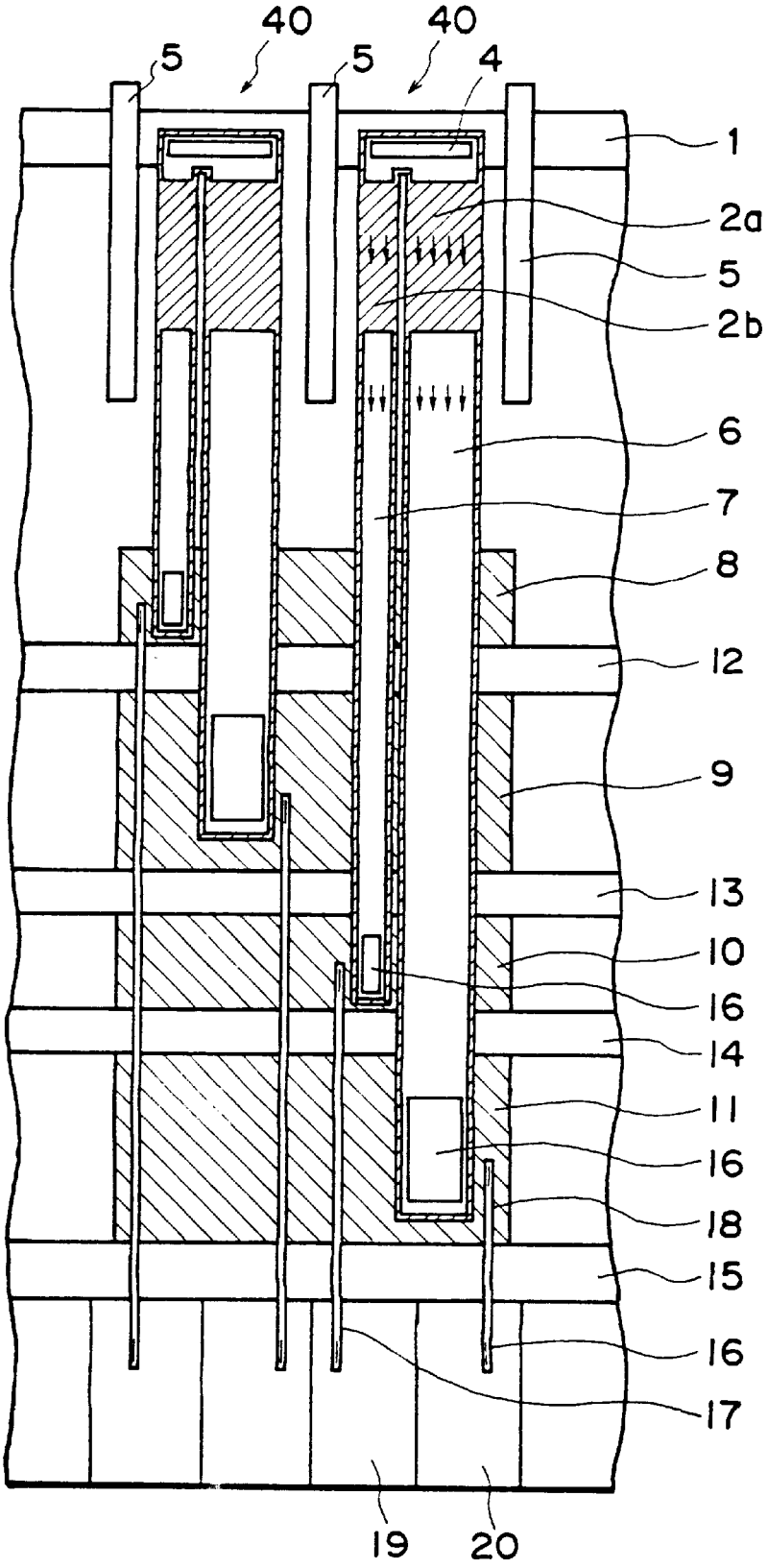
FIG. 5 illustrates an element position on a substrate constituting a base of an ink jet recording head according to an embodiment of the invention.

FIG. 5 shows an arrangement of elements integrally built in the element substrate through a semiconductor manufacturing step, in an ink jet head according to an embodiment of the present invention. On the element substrate, a nozzle walls 5 are provided, and in a single ejection nozzle between adjacent nozzle wall 5, there are provided a large heat generating resistor (ejection heater) 2*a* and a small ejection heater 2*b* under the same conditions as in the foregoing embodiment. The respective ejection heaters are connected with a common wiring 1 below a lower insulation heater of the ejection heater through through hole 4 so as to be supplied with a voltage. Wiring 6 and 7 are connected between large ejection heater 2*a* and small ejection heater 2*b* and switching transistor s11 and 10, respectively through the through hole 16.

Figure 6:
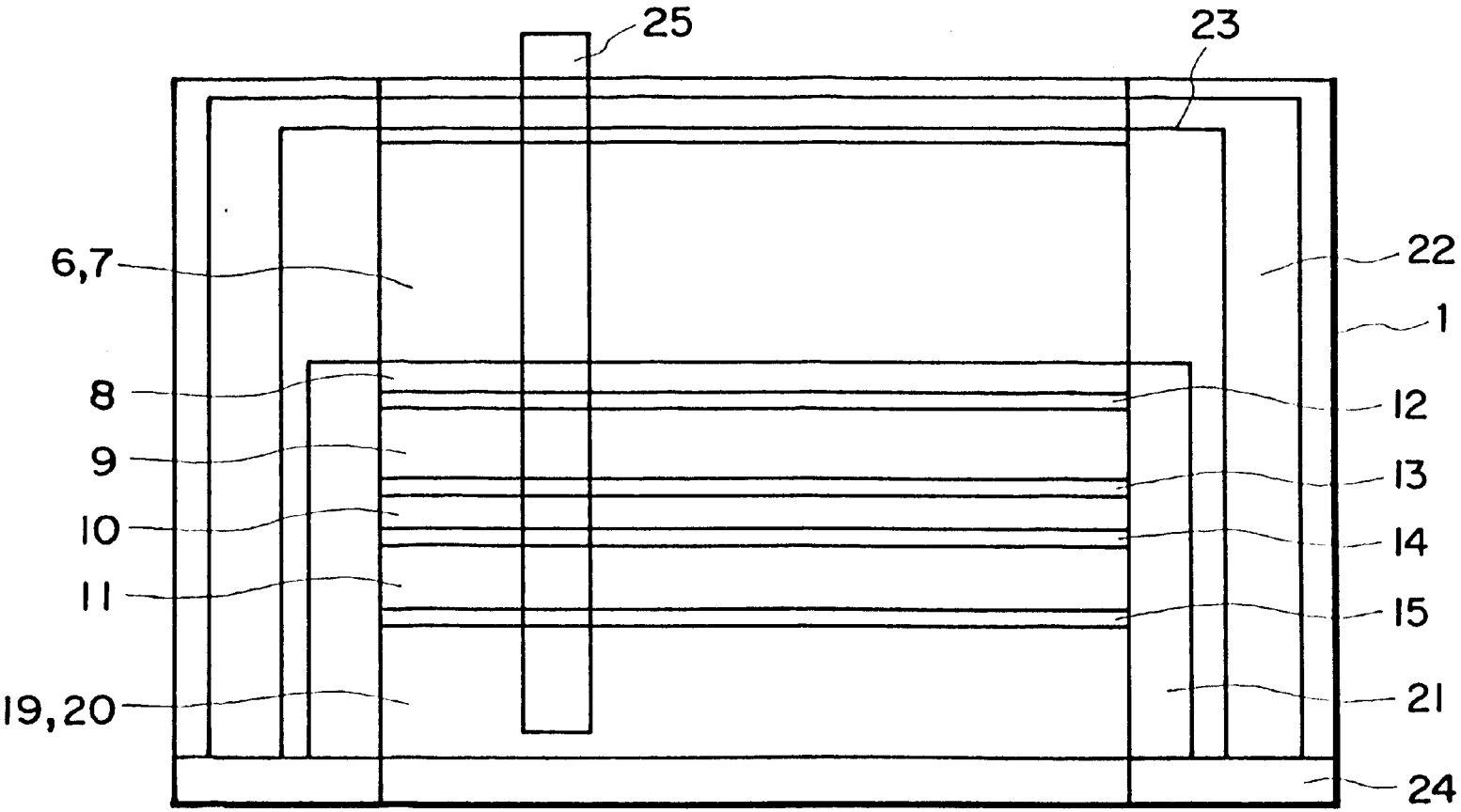
FIG. 6 shows a general arrangement of a substrate constituting a base of the ink jet recording head of FIG. 5.
Figure 7:
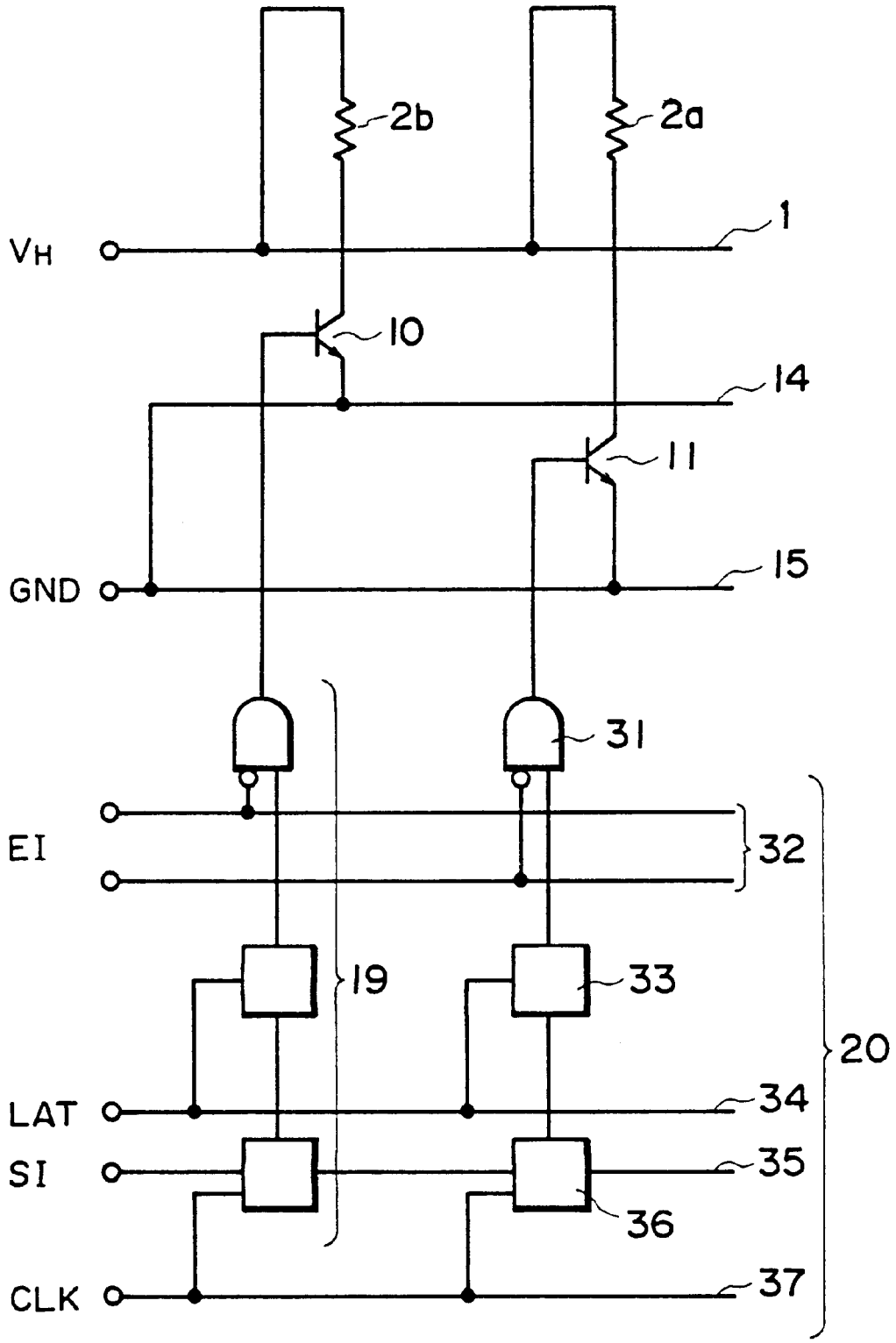
FIG. 7 shows an equivalent circuit of FIG. 5.
Figure 8:
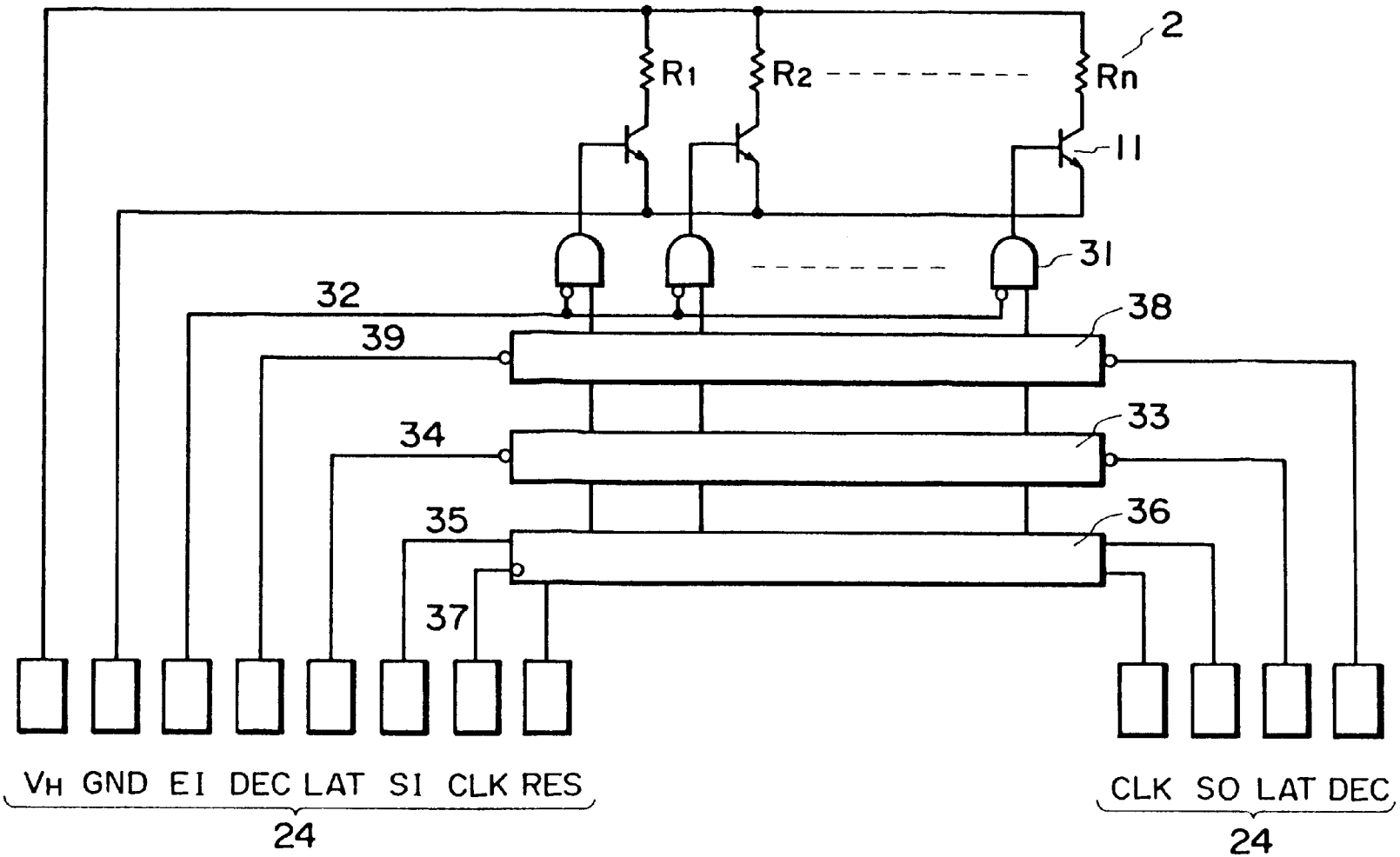
FIG. 8 shows an equivalent circuit of FIG. 6.
Figure 9:
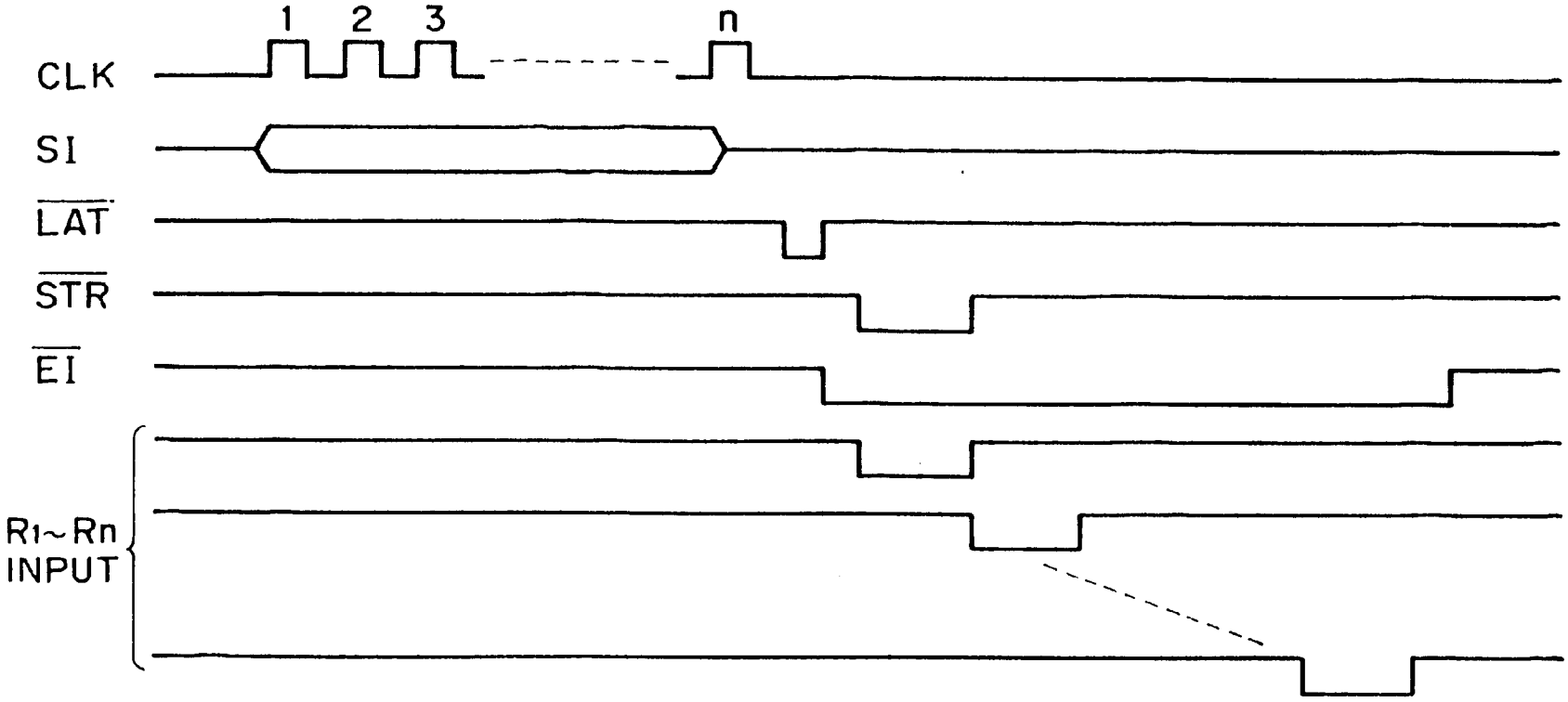
FIG. 9 is timing chart of driving of an ink jet recording head according to and embodiment of the present invention.

The switching transistors 10 and 11 are also disposed below the lower insulation film of the heater. In order to limit ON/OFF of the transistors 10 and 11, signal wiring 17 and 18 is connected between the transistors 10 and 11 and the shift registers and latching circuits 19 and 20. By doing so, the driving of the heater is limited by ON/OFF of the transistors in accordance with the data taken by the shift register and the latching circuit. Ground wirings 12, 13, 14 and 15 are connected to emitters of the switching transistors 8, 9, 10 and 11. In FIG. 5, two nozzles are shown. FIG. 6 shows the entire arrangement of the element substrate. In FIG. 6, the element substrate 1 is constructed by the continuous arrangement of the cells 25 of single structure. The common wiring 23 is connected to contact of 24 by a common longitudinal wiring 21 to permit electric energy supply thereto. Ground wirings 12, 13, 14 and 15 are connected to contact of 24 by ground longitudinal wiring 21. FIG. 7 shows details of the shift register, the latching circuits 19 and 20. The shift register 36, CLK signal line 37 and serial data line 35 are supplied to convert the serial data to the shift register 36 in accordance with the clock signal. The data supplied to the shift register 36 are retained in the latch 33 by the latching signal from the latching signal line 34. Then, the enabling signal 32 is connected to a AND gate 31 to supply a timing signal for applying the data from the latch 33 to the transistor 11. Since there are two enabling signals 32, the ejection heaters 2*a* and 2*b* can be driven simultaneously or at different timing. FIG. 8 shows an equivalent circuit of the general arrangement of the substrate 23 wherein the cells of FIG. 7 are continuously arranged. There are a decoder circuit 38 and a decoder signal line 39, which function to change the driving timing, thus permitting drive at various timings with a smaller number of contacts, that is, without a plurality of enabling signals 32. FIG. 9 shows a fundamental timing chart.

Figure 10:
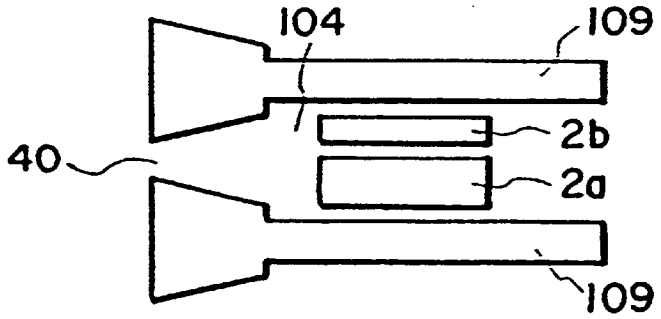
FIGS. 10(*a*), 10(*b*), 10(*c*) and 10(*d*) show an example of control of ejection states of the ink in an ink jet recording head according to an embodiment of the present invention.
Figure 10:
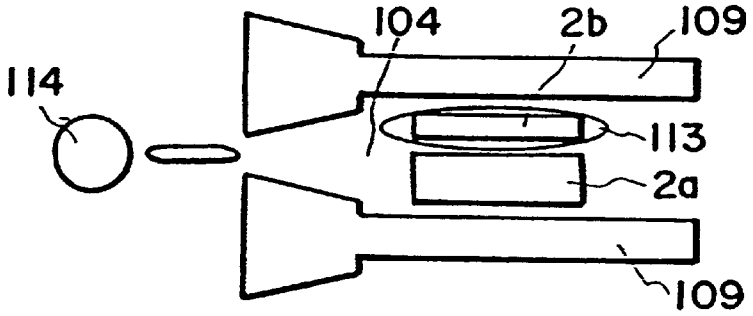
Figure 10:
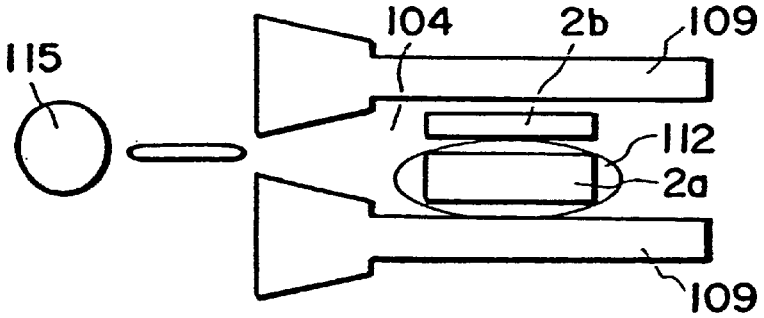
Figure 10:
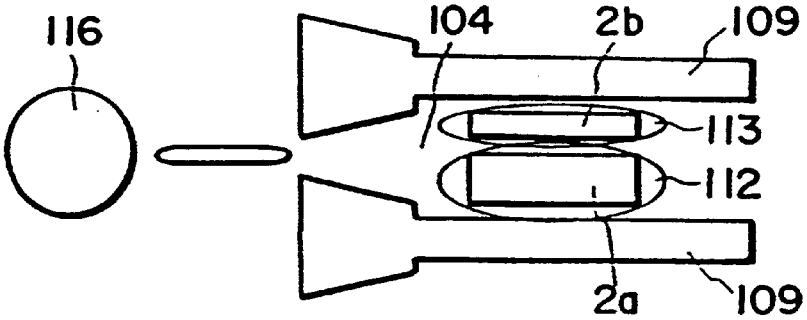
Figure 11:
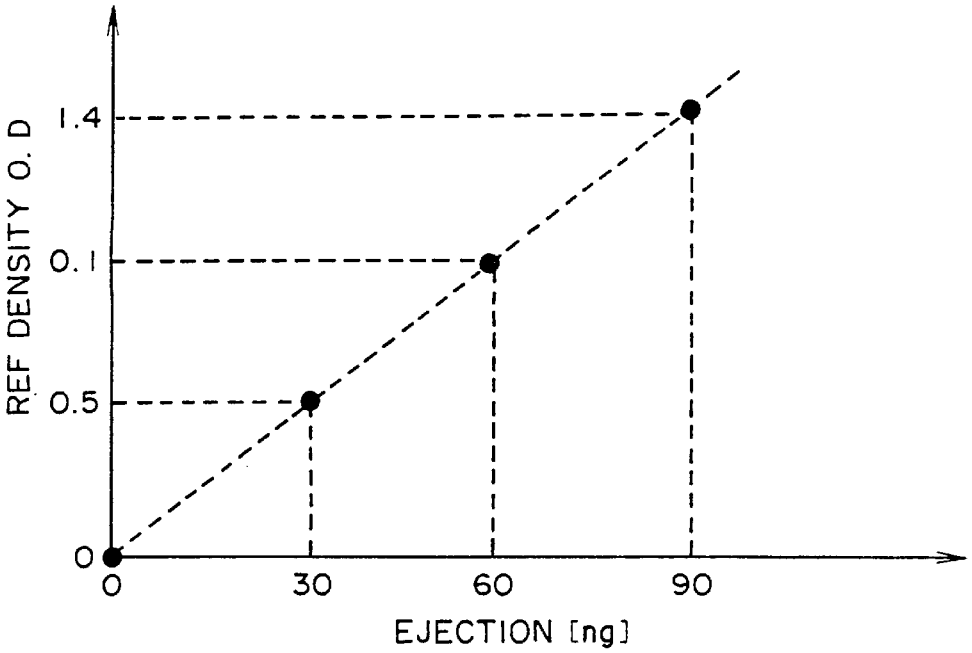
FIG. 11 shows a reflection temperature when an image is formed using a control of FIG. 10.

FIG. 10 shows a control of ejection amount of ink using the element substrate. As shown in (a), the ejection nozzle 104 between the nozzle walls 109 is filled with ink. When the ejection heaters 2*a* and 2*b* are heated to generate a bubble, the-ink is ejected by the bubble generation pressure through the orifice 40. As shown in (b), the small ejection heater 2*b* is energized, and the small droplet 114 of the ink is ejected. The ejection amount at this time is approx. 30 ng, for example. Then, (c) shows the ejection of a large droplet 115 by a large scale bubble generation 112 by energization of the large ejection heater 2*a*. If the large ejection heater 2*a* has an area which is twice the area of the small ejection heater 2*b*, the ejection amount which is proportional to the area of the heater, the ejection amount is approx. 60 ng. In (d), both of the small ejection heater 2*b* and the large ejection heater 2*a* are energized. In this case, the area of the ejection heater is 3 times as large as the small ejection heater (in the case of (b)), and the ejection amount is 90 ng (30×3). When the image is formed with such an ejection amount, the reflection density is as shown in FIG. 11. Since the density is proportional to the ink ejection amount, three levels of the densities can be provided. In other words, 4 tone levels are provided by two heaters which are large and small.

EMBODIMENT 3

Figure 12:
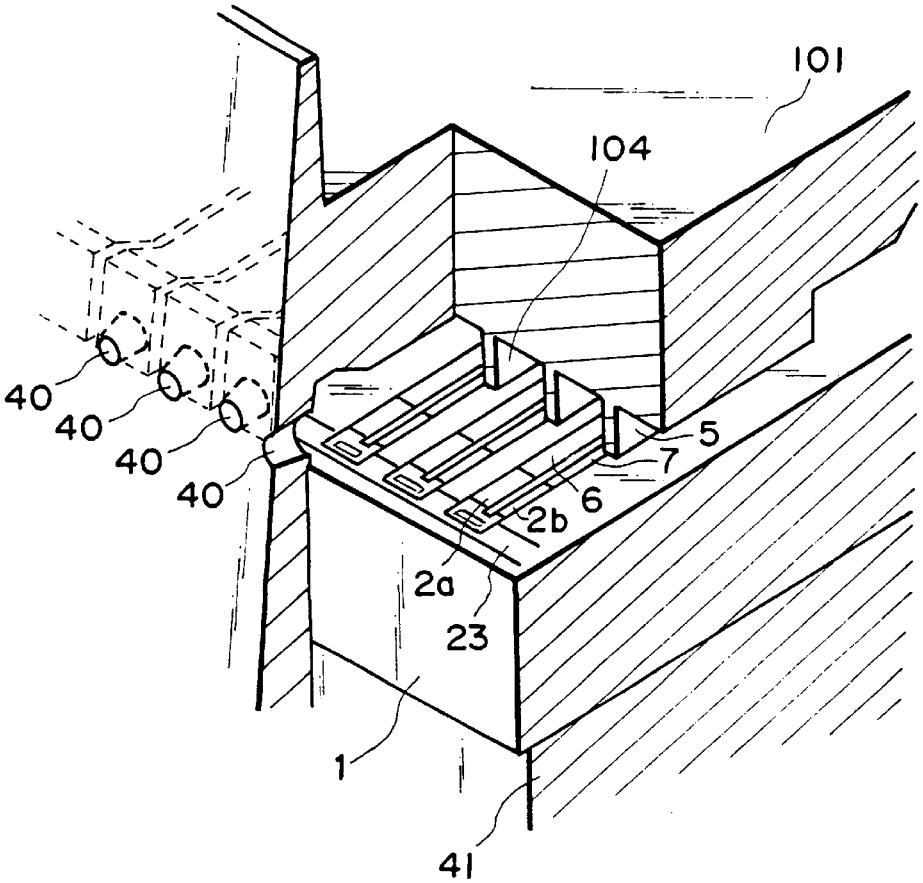
FIG. 12 shows an example of a construction of an ink jet recording head according to an embodiment of the present invention.
Figure 13:
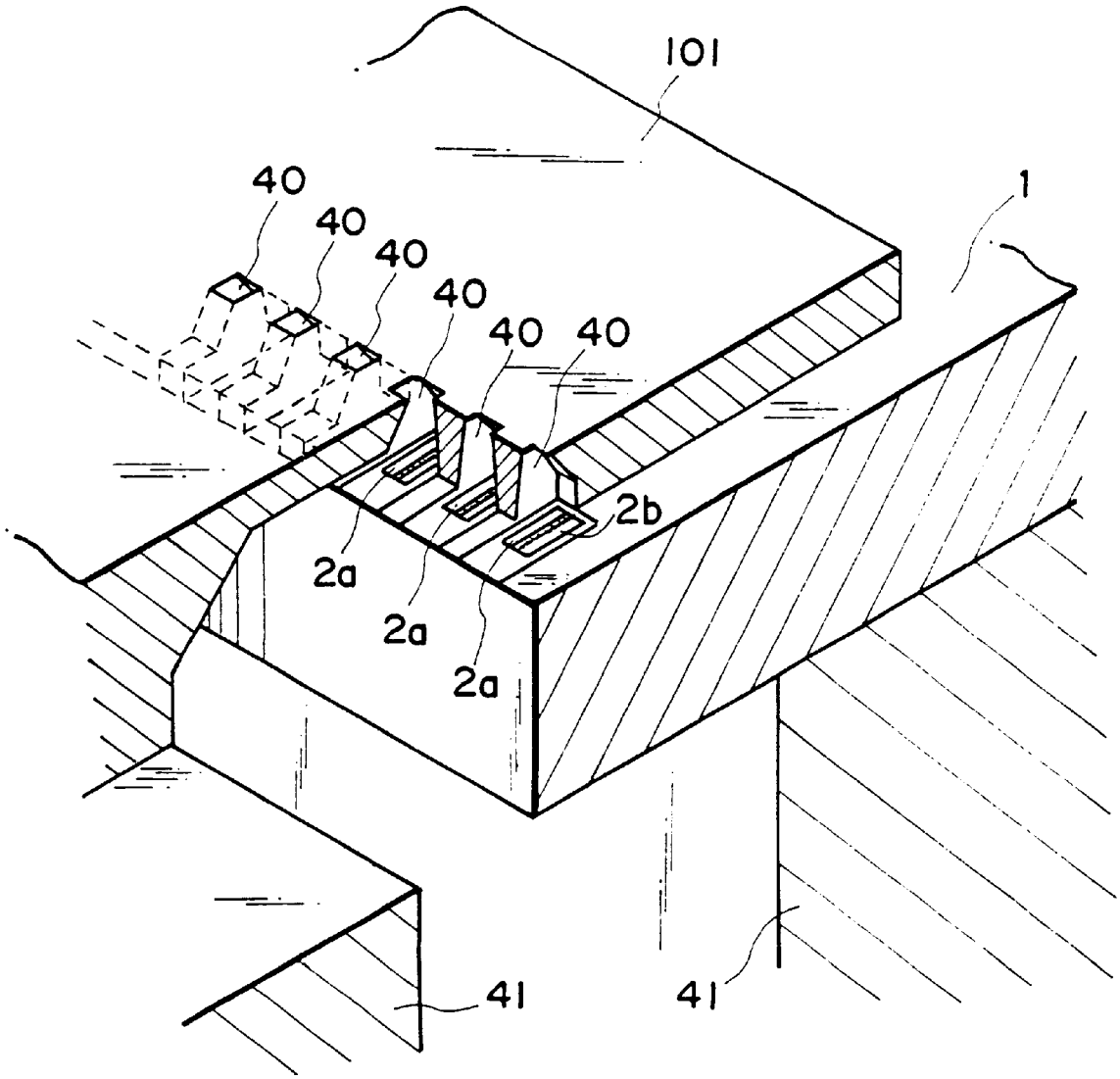
FIG. 13 shows example of a construction of ink jet recording head according to an embodiment of the present invention.

The structure of the head described above will be more specifically described. FIGS. 12 and 13 show the construction around the nozzle. They are called edge shooter type and side shooter type, respectively. The ink in the liquid flow path 104 is heated and a bubble is generated by the ejection heaters 3 and 4 to eject the ink through the ejection outlet 40 which is open in the horizontal direction in the drawing (along the surface having the heater) in the edge shooter type, or upwardly (in the direction normal to the surface having the heater) in the side shooter type. The element substrate 1 is bonded to the base plate 41, and the nozzle wall 5 is formed in the top plate 101.

Figure 14:
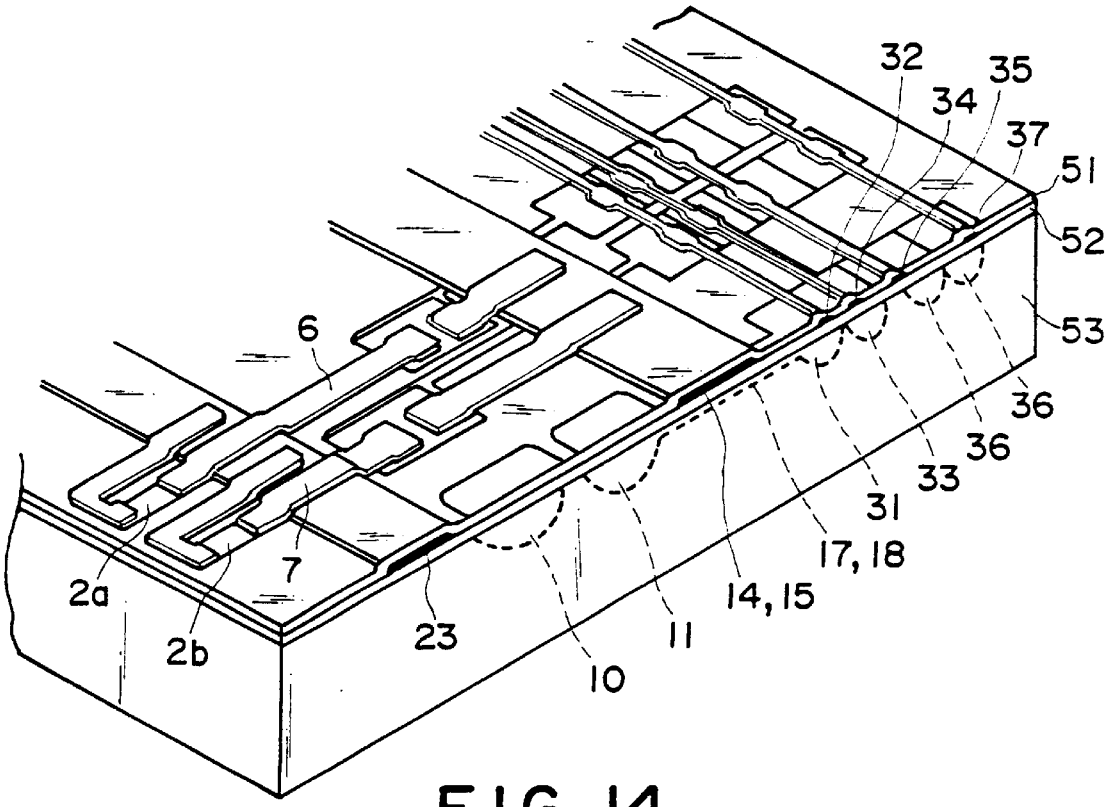
FIG. 14 shows a modified example of FIG. 5.
Figure 15:
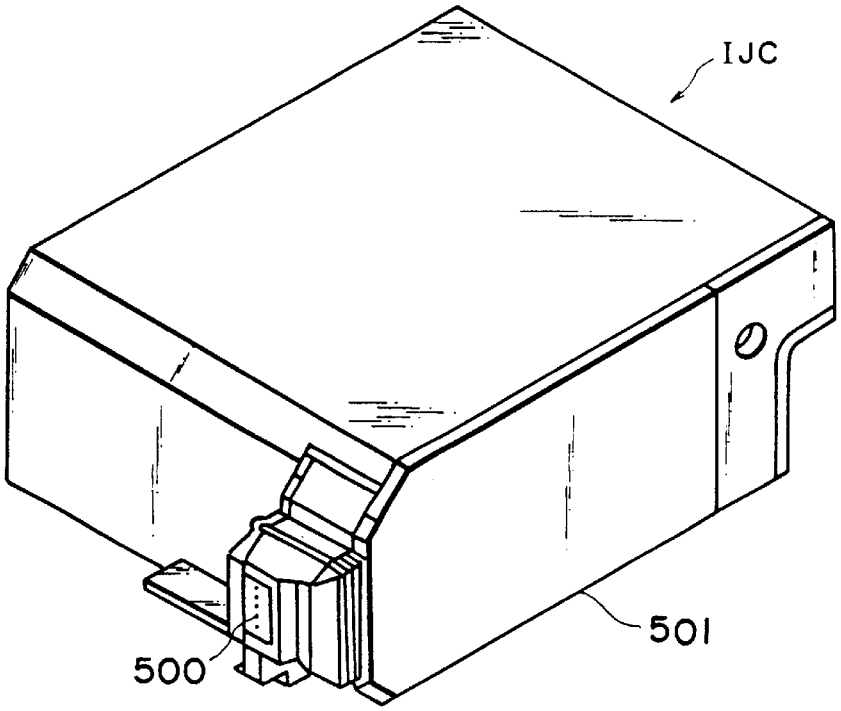
FIG. 15 illustrates an ink jet head cartridge using the head according to an embodiment of the present invention.

FIG. 14 shows a fundamental construction although the substrate is slightly different for the structure shown in FIG. 15. Below the ejection heaters 2*a* and 2*b*, an insulation film 51 is provided to provide electric insulation between the aluminum wiring B (wiring 6 and 7) at the heater side and aluminum wiring A (common wiring 1, ground wirings 14 and 15). The transistors 10 11 are connected with a silicon layer 53 through latch 33 and AND gate 31. The transistor 10, 11, AND gate 31, latch 33 and shift register 36 are formed in the silicon layer 53.

EMBODIMENT 4

FIG. 15 shows an ink jet head cartridge having an ink jet head and a separable ink container containing the ink to be supplied to the ink jet head.

The injection of the ink into the ink container of the ink jet head cartridge is carried out as follows.

By connection an ink supply pipe or the like to the ink container, an ink introduction path for the ink filling is constituted, and the ink is supplied into the ink container through the ink introduction path. As for ink supply openings, the supply opening or the air vent of the ink jet head side and a hole in the wall of the ink container, are usable.

EMBODIMENT 5

Figure 16:
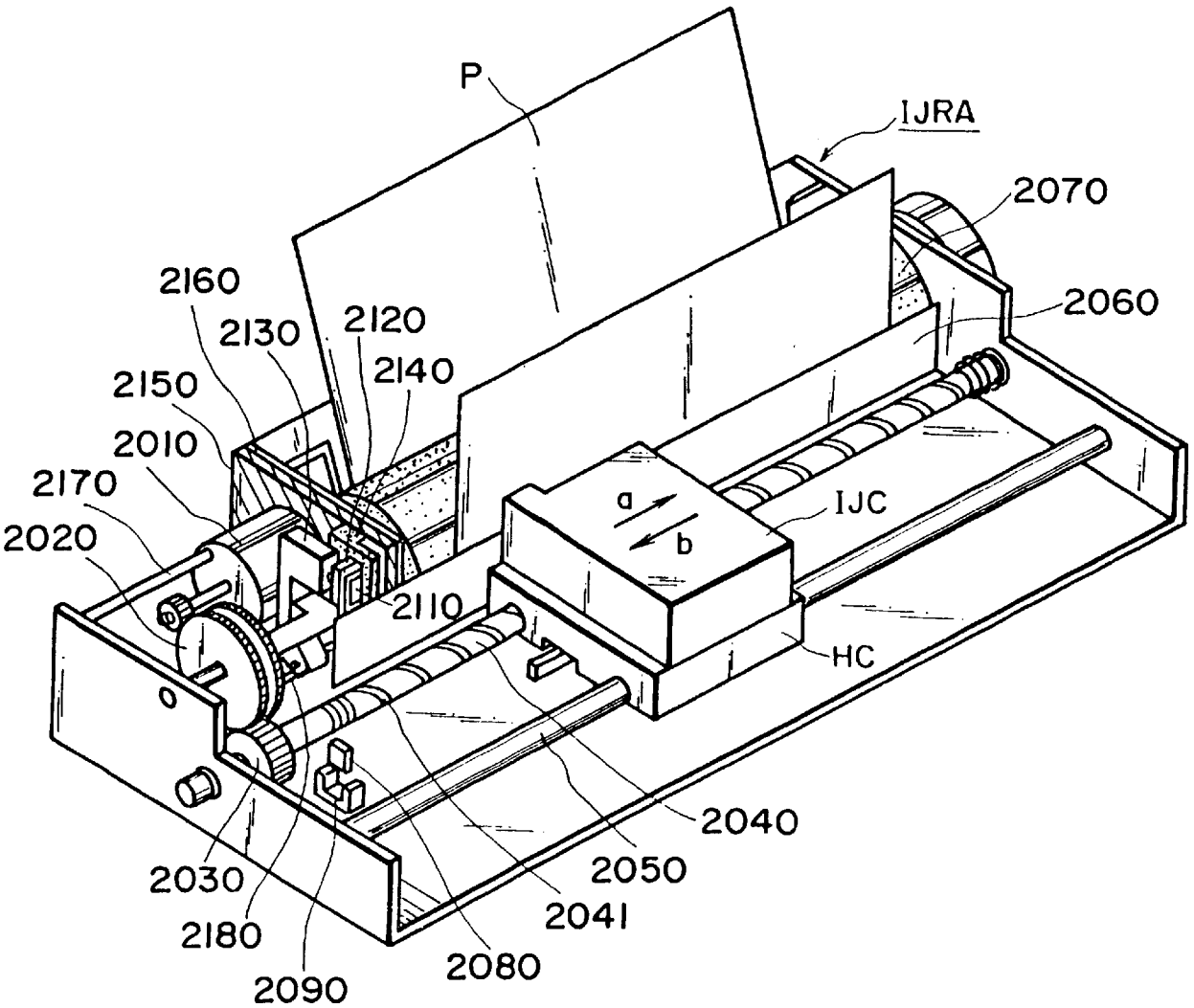
FIG. 16 shows an example of a construction of ink jet recording head mounted on an ink jet recording head according to an embodiment of the present invention.

FIG. 16 is a schematic view of an example of the ink jet recording device having the ink jet recording head described above. The ink jet recording device IJRA has a lead screw 2040 rotatable through driving force transmission gears 2020 and 2030 in interrelation with the reversible rotation of a driving motor 2010. The carriage HC carrying the the ink jet cartridge IJC having integral ink jet wiring head and ink container is supported on the carriage shaft 2050 and the lead screw 2040, and has a pin (unshown) for engagement with a spiral groove 2041 of the lead screw 2040, and is reciprocation moved in the b direction indicated by an arrow a in accordance with the rotation of the lead screw 2040. Designated by 2060 is a sheet confining plate, and urges the paper P to the platen roller 2070 along the carriage movement direction. A photo-coupler is constituted by elements 2080 and 2090, it confirms existence of a lever 2100 of the carriage HC in this area to effect rotational direction switching of the motor 2010, that is, the photo-coupler functions as a home position detecting means. Designated by 2110 is a cap member for caping the before surface of the recording head, and is supported by supporting member 2120. Designated by 2130 is a sucking means for sucking the inside of the cap to effect the sucking recovery of the recording head through the opening of the cap. A cleaning blade 2140 for cleaning the end surface of the recording head is mounted on a member 2150 for movement in the to and fro direction, and they are supported on a supporting plate 2160 of the main assembly. The blade 2140 is not limited to the structure, but known cleaning blade is usable in this example. A lever 2170 is operable to start the sucking of the sucking recovery operation and is movable with the movement of a cam 2180 engaged with the carriage HC, so that the driving force from the driving motor 2010 is selectively transmitted by known transmitting means such as clutch switching means.

The capping, cleaning and sucking recovery operations are carried out when the carriage HC reaches the home position side region, by the operation of the lead screw 2040 at the respective positions. But, another known timing and operation are usable. The above-described constructions are preferable individually or in combination in practicing the present invention.

Figure 17:
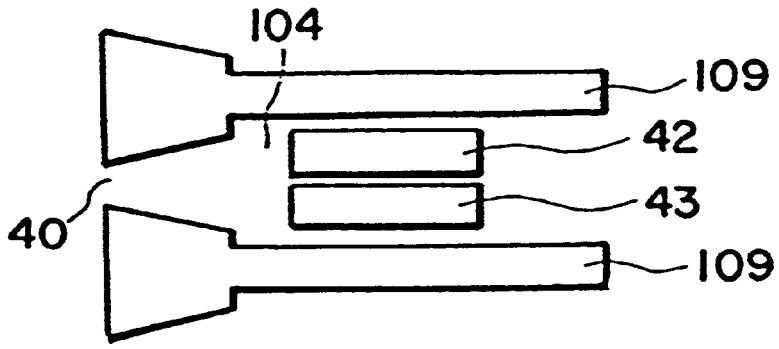
FIGS. 17(*a*), 17(*b*) and 17(*c*) show an example of a construction of an ink jet recording head according to another embodiment of the present invention.
Figure 17:
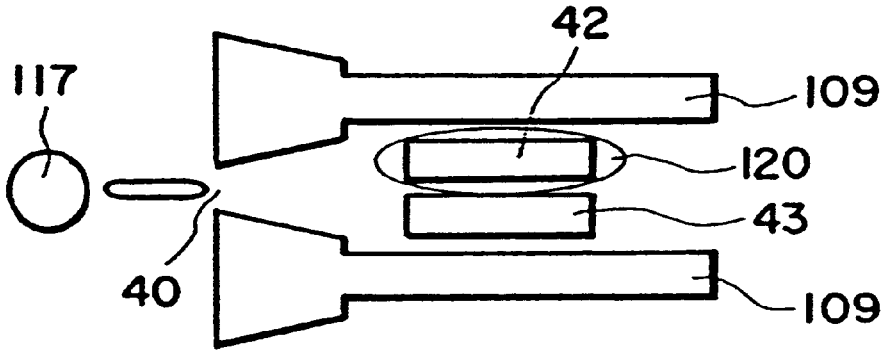
Figure 17:
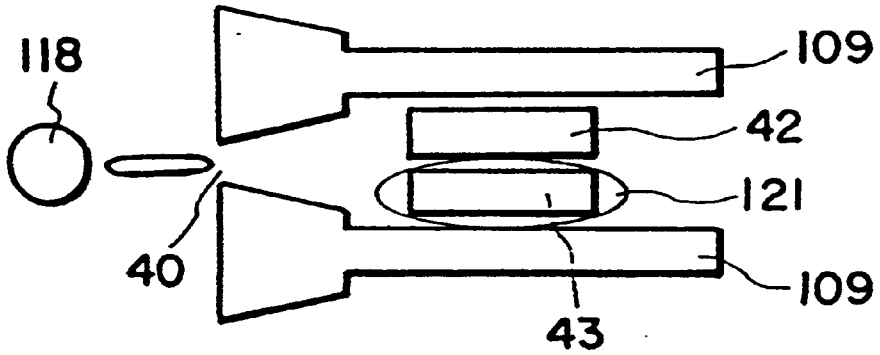

FIG. 17 shows a fundamental structure of a long lifetime heater usable with the present invention. As shown in FIG. 17, (a), a first heater 42 and a second heater 43 juxtaposed along the length has the same heater size. Therefore, the ejection amounts of the droplets 117 and 118 ejected by energizing the first heater 42 and by energizing the second heater 43, are the same. With this structure, the ejection data are alternately assigned to the two heaters to double the heater lifetime. Instead of alternate use of the heaters, it is a possible alternative that the first heater 42 is first used, and the second heater 43 is after the first heater 42 is actuated for a predetermined number of times or the first heater 42 is broken by electric disconnection or the like.

EMBODIMENT 6

Figure 18:
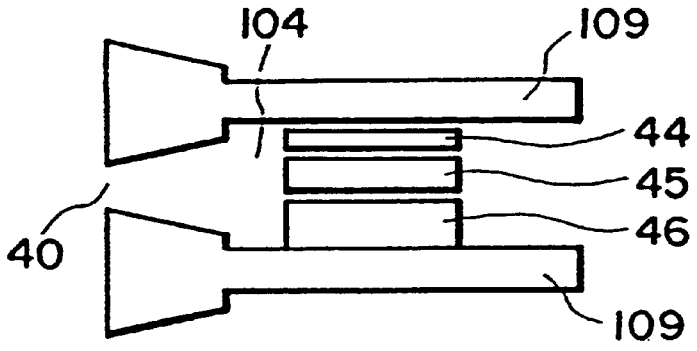
FIGS. 18(*a*) and 18(*b*) show an example of a control for an 8 tone gradient in an ink jet recording head according to an embodiment of the present invention.

FIG. 18 shows an example of 8 level tone gradient control. As shown in FIG. 18, (a), in this case, the heater sizes of the small ejection heater 2*c*, intermediate ejection heater 2*b* and the large ejection heater 2*a* juxtaposed, satisfy 1:2:4. By the combination of the three heaters, the ejection amount can be controlled with increment of long step from 0–70 ng, so that the image quality can be improved. The manner of the control is shown in (b).

Similarly, by using 4 heaters, 16 tone gradient levels can be used, and in more generic way, by using x heaters, 2x tone levels become available. The ejection heater of this embodiment also uses the positional features of embodiment 1.

EMBODIMENT 7

Figure 19:
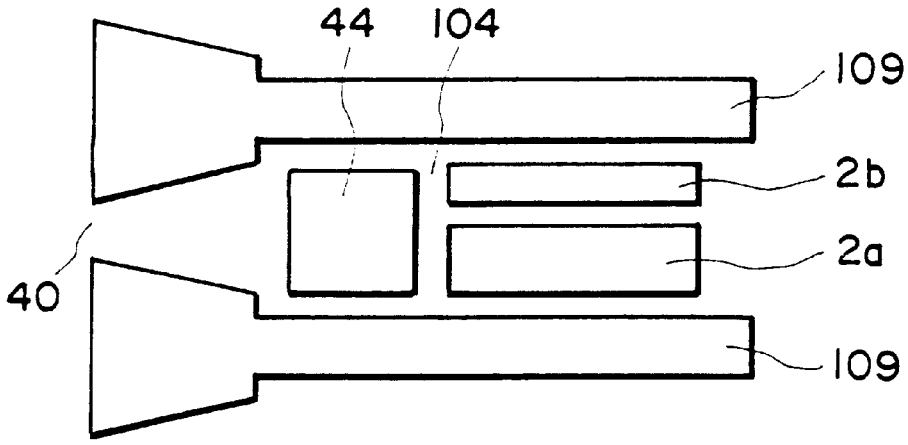
FIG. 19 shows example of a construction for analog tone gradient in an ink jet recording head according to an embodiment of the present invention.

FIG. 19 shows a construction for analog tone gradient. This embodiment uses the fact that the temperature of the ink in the ink jet recording head is influential to the ejection amount, and the ink temperature is controlled to provide a predetermined ejection amount.

Figure 20:
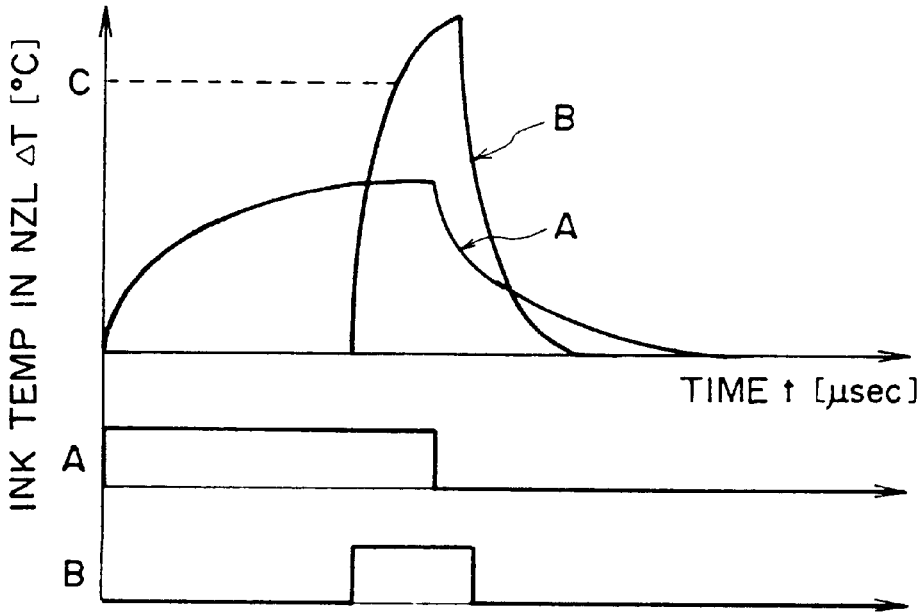
FIG. 20 shows example of control for construction of FIG. 19.
Figure 21:
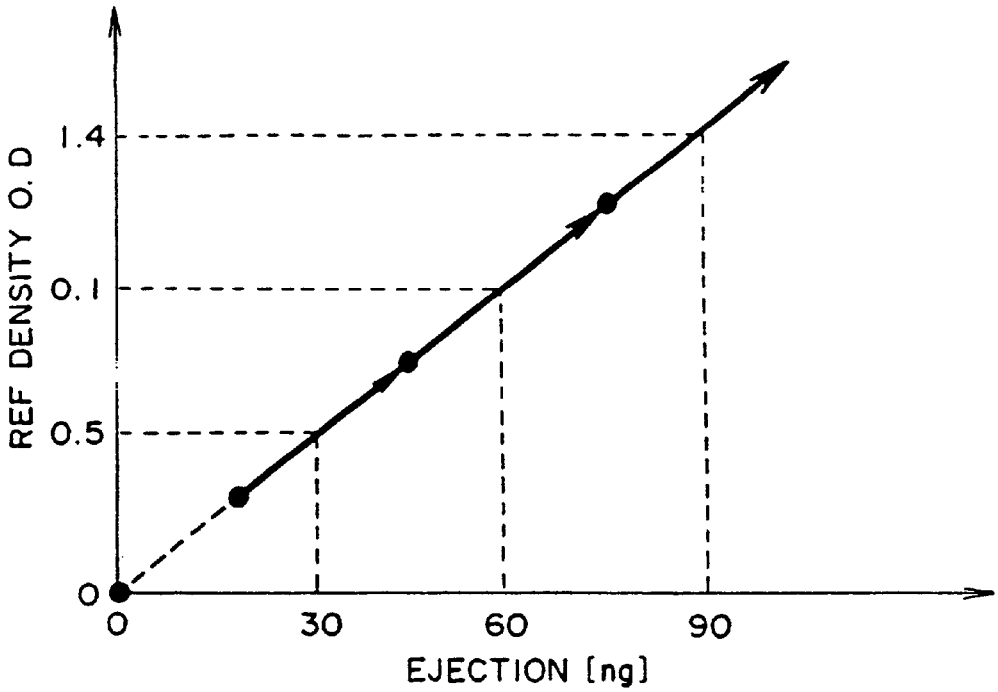
FIG. 21 shows example of reflection temperature in the construction of FIG. 19.
Figure 22:
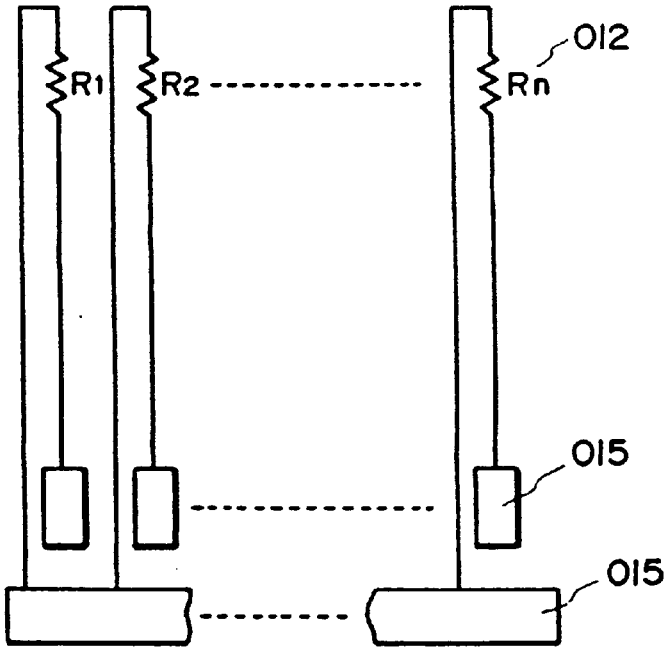
FIG. 22 PRIOR ART
FIG. 22 shows an equivalent circuit for a construction of a substrate of a conventional ink jet head.
Figure 23:
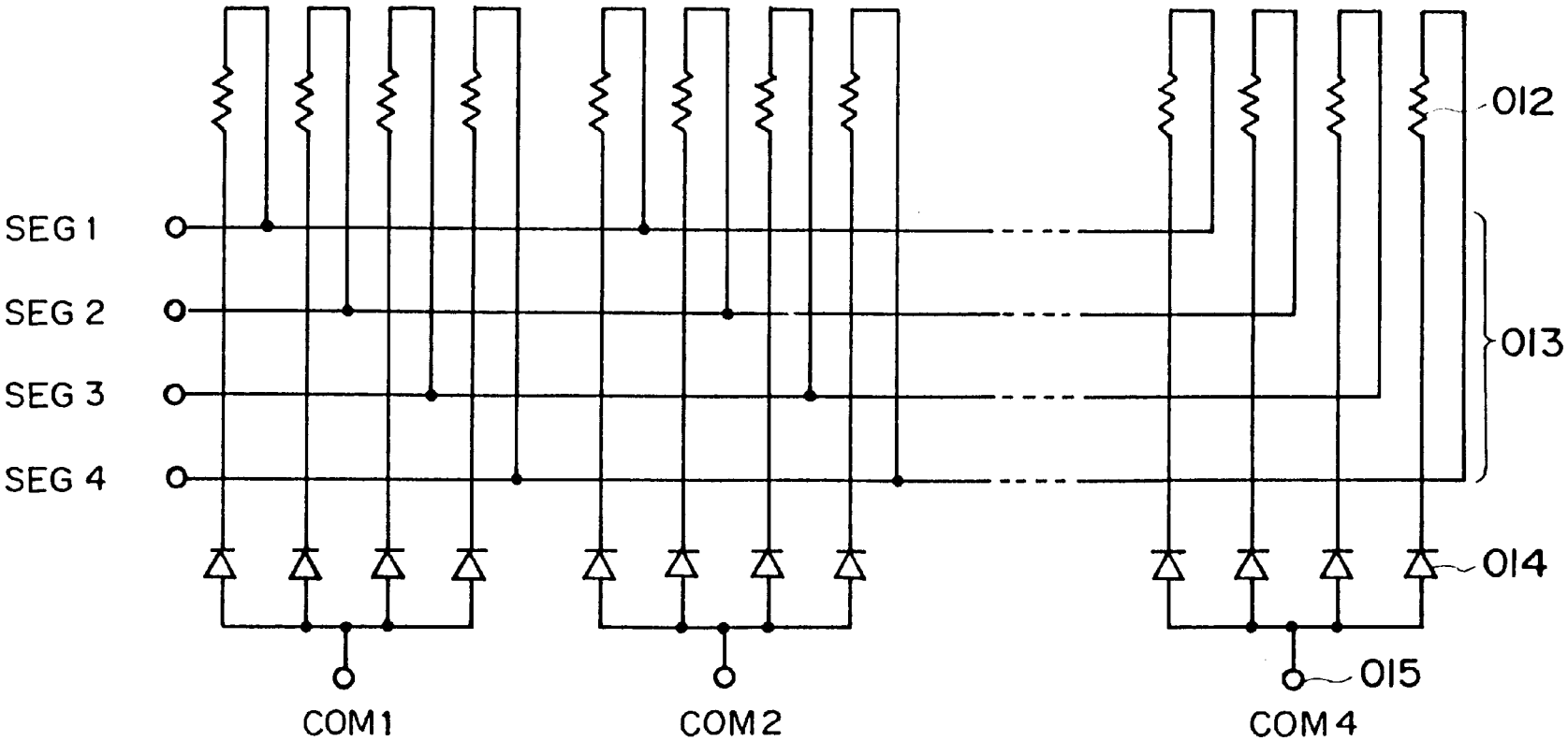
FIG. 23 shows an equivalent circuit of a substrate construction of an ink jet head.

As shown in FIG. 19, in this embodiment, there are provided large and small ejection heaters 3 and 4 juxtaposed and an ink pre-heating heater 44 in front thereof in the ink ejecting direction. This embodiment utilizes the fact that an amount of larger with the same bubble generation power amount of the ink can be ejected if the temperature is higher, since then the ink viscosity is lower, the ink pre-heating heater 44 is effective for pre-heating of the ink to provide fine change of the ejection amount. For example, as shown in FIG. 20, the ink temperature is raided by the signal A applied to the ink pre-heating heater 44, and then the signal B is applied to the ejection heater 2*a* or 2*b* to eject the ink. At this time, point C designates the temperature at which the bubble generation of the ink occurs, and the temperature of the ink provided by the ink pre-heating heater 44 does not exceed this temperature. With this system, the digital tone gradient of embodiment 1 can be operated as analog-like tone gradient in effect, as shown in FIG. 22.

The change of the ejection amount due to the change of the head temperature can be suppressed by controlling the ink temperature in the ejection nozzle 104 by the ink pre-heating heater 44 to provide a predetermined ejection amount. In a conventionally method of ejection amount control for a single heater, a pre-pulse is applied prior to the main pulse to effect the pre-heating. If the pre-pulse is large, the bubble generation may occur, and therefore, the ink heating is limited to a degree lower than predetermined. However, according to this this embodiment, the ink pre-heating heater 44 is independent from the ejection heater, and therefore, a large heater having low power per unit area of the heater for heating up to a degree of not producing bubble generation, is usable for pre-heating so that the ejection amount control can be enhanced.

As described above, a plurality of heaters are provided in a single nozzle, and the function element is provided in the substrate, by which the following advantageous effects can be provided.

1. the heater size for providing a predetermined ejection amount can be reduced, and therefore, the energy saving can be accomplished correspondingly, so that the voltage source cost and the driver cost can be reduced.

2. since the heat generation in the non-bubble-generation region results in the wasteful energy and in addition functions to rise the temperature of the head, the viscosity of the ink having the temperature dependence property decreases with the result of variation of the ejection amount and therefore deterioration of the printing quality. However, the above-described reduction of the non-bubble-generation region can suppress the reduction of the viscosity and the deterioration of the printing quality.

3. the tone gradient control is possible with downsized head and device without cost increase.

4. the tone gradient control is possible without shortening the lifetime of the electrothermal transducer element.

5. the tone gradient control is possible with a smaller number of data (2x tone gradient levels with x bit) so that the data transfer time can be reduced, and the memory cost reduction is accomplished.

6. the tone gradient controllable is possible without increasing the driving oscillation of the nozzle.

7. since the position of the pixel is not deviated, the image quality is not deteriorated.

8. by sharing the ejection jobs by same size heaters, the lifetime expansion is accomplished.

9. by using a heater not producing a bubble, the effect of ejection amount control can be enhanced.

Particularly, it should be noted that the cost increase is hardly required despite the foregoing advantages, and the downsizing is accomplished, in the embodiment wherein the function element is provided in the substrate.

While the invention has been described with reference to the structures disclosed herein, it is not confined to the details set forth and this application is intended to cover such modifications or changes as may come within the purposes of the improvements or the scope of the following claims.

What is claimed is:

1. An element substrate for an ink jet recording head which effects recording by ejecting an ink from a plurality of nozzles, said substrate comprising:

a plurality of heat generating resistor elements, provided on an insulative layer, for ejecting the ink, said plurality of heat generating resistor elements being provided for each of said nozzles;

a first wiring which is connected between each of said plurality of heat generating resistor elements and a common line through a through-hole formed in said insulative layer, wherein the common line applies a voltage commonly to said heat generating resistor elements for the plurality of nozzles; and a second wiring which is electrically connected to each of said heat generating resistor elements and associated ones of a plurality of driving elements for driving the heat generating resistor elements independently from each other, wherein said heat generating resistor elements are disposed between said common line and said driving elements on the substrate, and wherein said first wiring, said heat generating resistors and said second wiring are disposed in this order on said element substrate.

2. A substrate according to claim 1, wherein the heat generating resistor elements provided for each of said nozzles have different areas.

3. A substrate according to claim 2, wherein a portion of said second wiring for a smaller area heat generating resistor element has a smaller length and a smaller width than a portion of said second wiring for a larger area heat generating resistor element.

4. A substrate according to claim 1, wherein said driving elements are switching transistors.

5. An ink jet recording head which effects recording by ejecting an ink from a plurality of nozzles, said recording head comprising:

an element substrate including a plurality of heat generating resistor elements, provided on an insulative layer, for ejecting the ink, said plurality of heat generating resistor elements being provided for each of said nozzles;

a first wiring which is connected between each of said plurality of heat generating resistor elements and a common line through a through-hole formed in said insulative layer, wherein the common line applies a voltage commonly to said heat generating resistor elements for the plurality of nozzles;

a second wiring which is electrically connected to each of said heat generating resistor elements and associated ones of a plurality of driving elements for driving the heat generating resistor elements independently from each other; and nozzle walls for defining the nozzles, wherein said heat generating resistor elements are disposed between said common line and said driving elements on the substrate, and wherein said first wiring, said heat generating resistors and said second wiring are disposed in this order on said element substrate.

6. A recording head according to claim 5, wherein the heat generating resistor elements provided for each of said nozzles have different areas.

7. A recording head according to claim 6, wherein a portion of said second wiring for a smaller area heat generating resistor element has a smaller length and a smaller width than a portion of said second wiring for a larger area heat generating resistor element.

8. A recording head according to claim 5, wherein said driving elements are switching transistors.

9. An ink jet recording apparatus wherein recording is effected by ejecting an ink from a plurality of nozzles, said apparatus comprising:

an ink jet recording head including:

an element substrate including a plurality of heat generating resistor elements, provided on an insulative layer, for ejecting the ink, said plurality of heat generating resistor elements being provided for each of said nozzles;

a first wiring which is connected between each of said plurality of heat generating resistor elements and a common line through a through-hole formed in said insulative layer, wherein the common line applies a voltage commonly to said heat generating resistor elements for the plurality of nozzles;

a second wiring which is electrically connected to each of said heat generating resistor elements and associated ones of a plurality of driving elements for driving the heat generating resistor elements independently from each other; and nozzle walls for defining the nozzles; and said apparatus further comprising means for mounting said ink jet recording head, wherein said heat generating resistor elements are disposed between said common line and said driving elements on the substrate, and wherein said first wiring, said heat generating resistors and said second wiring are disposed in this order on said element substrate.

10. An apparatus according to claim 9, wherein the heat generating resistor elements provided for said nozzles have different areas.

11. An apparatus according to claim 10, wherein a portion of said second wiring for a smaller area heat generating resistor element has a smaller length and a smaller width than a portion of said second wiring for a larger area heat generating resistor element.

12. An apparatus according to claim 9, wherein said driving elements are switching transistors.

13. An element substrate for an ink jet recording head which effects recording by ejecting an ink from a plurality of nozzles, said substrate comprising:

a plurality of heat generating resistor elements, provided on an insulative layer, for ejecting the ink, said plurality of heat generating resistor elements being provided for each of said nozzles;

a first wiring which is connected between each of said plurality of heat generating resistor elements and a common line through a through-hole formed in said insulative layer, wherein the common line applies a voltage commonly to said heat generating resistor elements for the plurality of nozzles; and a second wiring which is electrically connected to each of said heat generating resistor elements and associated ones of a plurality of driving elements for driving the heat generating resistor elements independently from each other, wherein said through-hole is common for said plurality of heat generating resistors.

14. A substrate according to claim 13, wherein the heat generating resistor elements provided for each of said nozzles have different areas.

15. A substrate according to claim 14, wherein a portion of said second wiring for a smaller area heat generating resistor element has a smaller length and a smaller width than a portion of said second wiring for a larger area heat generating resistor element.

16. A substrate according to claim 13, wherein said driving elements are switching transistors.

17. An ink jet recording head which effects recording by ejecting an ink from a plurality of nozzles, said recording head comprising:

an element substrate including a plurality of heat generating resistor elements, provided on an insulative layer, for ejecting the ink, said plurality of heat generating resistor elements being provided for each of said nozzles;

a first wiring which is connected between each of said plurality of heat generating resistor elements and a common line through a through-hole formed in said insulative layer, wherein the common line applies a voltage commonly to said heat generating resistor elements for the plurality of nozzles;

a second wiring which is electrically connected to each of said heat generating resistor elements and associated ones of a plurality of driving elements for driving the heat generating resistor elements independently from each other; and nozzle walls for defining the nozzles, wherein said through-hole is common for said plurality of heat generating resistors.

18. A recording head according to claim 17, wherein the heat generating resistor elements provided for each of said nozzles have different areas.

19. A recording head according to claim 18, wherein a portion of said second wiring for a smaller area heat generating resistor element has a smaller length and a smaller width than a portion of said'second wiring for a larger area heat generating resistor element.

20. A recording head according to claim 17, wherein said driving elements are switching transistors.

21. An ink jet recording apparatus wherein recording is effected by ejecting an ink from a plurality of nozzles, said apparatus comprising:

an ink jet recording head including:

an element substrate including a plurality of heat generating resistor elements, provided on an insulative layer, for ejecting the ink, said plurality of heat generating resistor elements being provided for each of said nozzles;

a first wiring which is connected between each of said plurality of heat generating resistor elements and a common line through a through-hole formed in said insulative layer, wherein the common line applies a voltage commonly to said heat generating resistor elements for the plurality of nozzles;

a second wiring which is electrically connected to each of said heat generating resistor elements and associated ones of a plurality of driving elements for driving the heat generating resistor elements independently from each other; and nozzle walls for defining the nozzles;

said apparatus further comprising:

means for mounting said ink jet recording head, wherein said through-hole is common for said plurality of heat generating resistors.

22. An apparatus according to claim 21, wherein the heat generating resistor elements provided for said nozzles have different areas.

23. An apparatus according to claim 22, wherein a portion of said second wiring for a smaller area heat generating resistor element has a smaller length and a smaller width than a portion of said second wiring for a larger area heat generating resistor element.

24. An apparatus according to claim 21, wherein said driving elements are switching transistors.

* * * * *

UNITED STATES PATENT AND TRADEMARK OFFICE

CERTIFICATE OF CORRECTION

PATENT NO. : 6,439,690 B2
DATED : August 27, 2002
INVENTOR(S) : Hiroyuki Ishinaga et al.

It is certified that error appears in the above-identified patent and that said Letters Patent is hereby corrected as shown below:

Title page,
Item [56], References Cited, FOREIGN PATENT DOCUMENTS,
"55 132359" should read -- 55-132359 --; and
"1 235 652" should read -- 1-235652 --.

Column 1,
Line 27, "device" should read -- devices --;
Line 33, "may" should read -- many --;
Line 47, "An area of" should read -- The area of the --;
Line 48, "an important factors of" should read -- the important factors in the --;
Line 52, "elements." should read -- elements, -- and close up right margin;
Line 53, "¶ Since" should read -- because -- and close up left margin; and
Line 54, "is influential to another" should read -- influences other -- and "transducer." should read -- transducers. --.

Column 2,
Lines 11, 12, 15, 17 and 29, "of of" should read -- of --;
Line 37, "position" should read -- positions --;
Line 38, "optimization" should read -- optimized --;
Line 43, "of' should be deleted;
Line 50, "An" should read -- an --;
Line 57, "main-" should read -- container --; and
Line 58, "taining" should be deleted.

Column 3,
Line 14, "of of" should read -- of --;
Line 15, "transducer" should read -- transducers --;
Line 25, "timing" should read -- a timing --;
Line 26, "and" should read -- an --; and
Lines 36, 51, 55 and 57, "example" should read -- an example --.

Column 4,
Line 5, "the. embodiment," should read -- the embodiments, --;
Line 26, "of of" should read -- of --;
Line 31, "the of the" should read -- the temperature of the --;
Lines 35 and 67, "exhibit" should read -- exhibits --; and
Line 57, "b-b"' should read -- b-b'. --.

UNITED STATES PATENT AND TRADEMARK OFFICE

CERTIFICATE OF CORRECTION

PATENT NO. : 6,439,690 B2
DATED : August 27, 2002
INVENTOR(S) : Hiroyuki Ishinaga et al.

It is certified that error appears in the above-identified patent and that said Letters Patent is hereby corrected as shown below:

Column 5,
Line 7, "rise" should read -- raise --;
Line 15, "invent ion," should read -- invention, --;
Line 56, "heater s(heat" should read -- heaters (heat --;
Line 58, "enlargement." should read -- enlarged. --; and
Line 60, "become" should read -- becomes --.

Column 6,
Line 13, "corresponding" should read -- Corresponding --;
Line 17, "since" should read -- Since --;
Line 19, "rise" should read -- raise --;
Line 35, "resistor" should read -- resistors --;
Line 37, "driving" should read -- drive --;
Line 46, "a nozzle" should read -- nozzle --;
Line 47, "wall" should read -- walls --;
Line 55, "transistor s11" should read -- transistors 11 --;
Line 60, "wiring" should read -- wirings --; and
Line 61, "is" should read -- are --.

Column 7,
Line 18, "timing." should read -- timings. --;
Line 30, "the-ink" should read -- the ink --;
Line 40, "both of" should read -- both --; and
Line 67, "(wiring" should read -- (wirings --.

Column 8,
Line 3, "transistor" should read -- transistors --;
Line 13, "connection" should read -- connecting --;
Line 27, "the the" should read -- the --;
Line 32, "reciprocation" should read -- reciprocally --;
Line 34, "plate, and" should read -- plate that --;
Line 47, "direction," should read -- directions, --; and
Line 67, "has" should read -- have --.

Column 9,
Line 34, "amount of larger" should read -- larger amount --;
Line 39, "raided" should read -- raised --; and
Line 52, "conventionally" should read -- conventional --.

UNITED STATES PATENT AND TRADEMARK OFFICE

CERTIFICATE OF CORRECTION

PATENT NO. : 6,439,690 B2
DATED : August 27, 2002
INVENTOR(S) : Hiroyuki Ishinaga et al.

It is certified that error appears in the above-identified patent and that said Letters Patent is hereby corrected as shown below:

Column 10,
Lines 1, 13, 15 and 17, "the" should read -- The --;
Lines 4 and 24, "since" should read -- Since --;
Line 5, "the" should be deleted;
Line 6, "rise" should read -- raise --;
Line 19, "bit)" should read -- bits) --;
Line 22, "the tone gradient controllable" should read -- Tone gradient control --;
Line 26, "by sharing the ejection jobs by" should read -- By sharing the ejection jobs between --; and
Line 28, "by" should read -- By --.

Column 13,
Line 9, "said'second" should read -- said second --.

Column 14,
Line 8, "nozzles;" should read -- nozzles, --.

Signed and Sealed this

Twenty-ninth Day of July, 2003

JAMES E. ROGAN
*Director of the United States Patent and Trademark Office*